US005988942A

United States Patent [19]

Atkinson

[11] Patent Number: 5,988,942

[45] Date of Patent: Nov. 23, 1999

[54] EROSION CONTROL SYSTEM

[75] Inventor: Frank S. Atkinson, San Gabriel, Calif.

[73] Assignee: Stewart Trustees Limited, New Zealand

[21] Appl. No.: 08/814,370

[22] Filed: Mar. 11, 1997

Related U.S. Application Data

[60] Provisional application No. 60/030,508, Nov. 12, 1996.

[51] Int. Cl.[6] ..... E02B 3/12

[52] U.S. Cl. ..... 405/20; 405/19; 405/16; 404/40; 52/596

[58] Field of Search ..... 405/20, 16, 15, 405/17, 19, 284; 52/596, 607, 597–606, 608; 404/34, 35, 37, 40, 41, 249, 66.1, 117; 264/333

[56] References Cited

U.S. PATENT DOCUMENTS

| | | | |
|---|---|---|---|
| 3,168 | 7/1843 | Terry . | |
| 314,022 | 3/1885 | Heard | 52/605 |
| 436,989 | 9/1890 | McDowell . | |
| 554,354 | 2/1896 | Villa . | |
| 708,470 | 9/1902 | Flood . | |
| 790,507 | 5/1905 | Lamberson . | |
| 930,153 | 1/1909 | Butz . | |
| 991,041 | 5/1911 | Toennes | 405/20 |
| 1,144,143 | 6/1915 | McGillivray | 405/20 |
| 1,164,707 | 2/1915 | Edinger . | |
| 1,164,708 | 12/1915 | Edinger . | |
| 1,359,475 | 11/1920 | Willard . | |
| 1,436,896 | 11/1922 | Newell . | |
| 1,987,150 | 1/1935 | Mason . | |
| 2,008,866 | 7/1935 | Hoffard . | |
| 2,159,685 | 5/1939 | Buzzell . | |
| 2,493,458 | 1/1950 | Koenig | 72/102 |
| 2,674,856 | 4/1954 | Louckes . | |
| 2,876,628 | 3/1959 | Dixon, Jr. . | |
| 3,093,568 | 6/1963 | Cox | 204/193.2 |
| 3,096,695 | 7/1963 | Reinhardt | 94/11 |
| 3,310,906 | 3/1967 | Glukes | 46/25 |
| 3,347,048 | 10/1967 | Brown et al. . | |
| 3,386,252 | 6/1968 | Nelson | 138/96 |
| 3,420,275 | 1/1969 | Glen et al. | 138/96 |
| 3,421,417 | 1/1969 | Pilaar | 94/11 |
| 3,597,928 | 8/1971 | Pilaar . | |
| 3,903,702 | 9/1975 | Appleton . | |
| 3,922,865 | 12/1975 | Nijdam . | |
| 4,057,608 | 11/1977 | Hashimoto et al. | 264/42 |
| 4,152,875 | 5/1979 | Soland | 52/227 |
| 4,172,680 | 10/1979 | Brown | 405/16 |
| 4,227,829 | 10/1980 | Landry, Jr. | 405/20 |
| 4,370,075 | 1/1983 | Scales | 404/41 |
| 4,372,705 | 2/1983 | Atkinson | 405/16 X |
| 4,486,121 | 12/1984 | Thompson et al. | 405/17 |
| 4,664,552 | 5/1987 | Schaaf | 405/20 |
| 5,017,049 | 5/1991 | Sievert | 405/284 |
| 5,078,940 | 1/1992 | Sayles | 264/154 |
| 5,484,230 | 1/1996 | Rudloff | 405/16 X |
| 5,779,391 | 7/1998 | Knight | 405/16 X |

FOREIGN PATENT DOCUMENTS

| | | | |
|---|---|---|---|
| 134296 | 3/1785 | European Pat. Off. | 405/20 |
| 2123523 | 11/1972 | Germany . | |
| 2025494 | 1/1980 | United Kingdom . | |

*Primary Examiner*—David Bagnell
*Assistant Examiner*—Frederick Lagman
*Attorney, Agent, or Firm*—Conley, Rose & Tayon, P.C.

[57] ABSTRACT

The erosion control system includes a plurality of erosion control blocks connected to one another by connectors to form an interconnected network of erosion control blocks conforming to the underlying terrain for erosion prevention. Each erosion control block includes a plurality of apertures therethrough each forming a side wall. The connector includes a pair of projecting legs for insertion into adjacent erosion control blocks. Each leg attachingly engages the side wall of the aperture of an erosion control block for connecting that erosion control block to an adjacent block. The legs include tapered extensions which frictionally engage the side wall, and in one embodiment of the erosion control block, the side wall includes a shoulder which engages the terminal end of the tapered extension. The erosion control block may have one end with convex arcuate surface and another end with a concave arcuate surface for providing an articulating joint between adjacent erosion control blocks. The erosion control block also may include a plurality of horizontal hydraulic grooves in the bottom planar surface of the block for hydrostatic relief.

48 Claims, 15 Drawing Sheets

EROSION CONTROL SYSTEM

CROSS REFERENCE TO RELATED APPLICATION

This is an application claiming the benefit of U.S. Provisional Application Serial No. 60/030,508 filed Nov. 12, 1996 and entitled Eroson Control System.

BACKGROUND OF THE INVENTION

The present invention relates to the control of soil erosion especially on the sides of rivers, drainage canals, riverbeds, levees, beaches, storm drains and the like, and more particularly relates to an erosion control system comprising a plurality of blocks, each of which is connected to the adjacent block by a connector which maintains horizontal and/or vertical block placement yet allows an articulated movement of the blocks with respect to one another allowing conformation of the overall block system to the underlying terrain, and still more particularly to blocks having horizontal hydraulic grooves for relieving hydrostatic pressure.

During the last 20 years, an industry has developed around the use of a variety of articulating concrete block matrices designed to control erosion. Most designs have the ability to conform, to varying degrees, to the settlement of soils and provide an environment for revegetation after excavation and construction of dikes, embankments and structures designed to withstand the erosive forces at the interface of water and land.

As the industry has grown, the physical properties of the devices have been tested by the Federal Highways Department and other Government departments and standard tests are being derived to assess the benefits of any system tested by these standard tests.

It is unanimously agreed in the industry and the specifying community that the principal attributes required of erosion control systems are the ability of individual blocks to remain stable during water flow in the channel or revetment profile and to relieve hydrostatic pressure under dynamic hydraulic conditions. The method and ease of installation and the degree to which the completed revetment will grow and support vegetation is a matter of choice for the end user.

The systems available today are assembled in matrix, either by connecting by means of cable or systems of interlock. See, for example, U.S. Pat. No. 4,372,705, incorporated herein by reference. The benefit of interlocking systems is that they can be laid manually. The disadvantage is, in applications that require laying in deep water, they need to be additionally cabled, incurring an additional cost of block production and installation.

The stability of the individual block is a function of the density of the concrete material, the length of the block in the direction of flow, the surface characteristics of the block and any physical connection with the adjacent blocks that would resist a turning moment. Water flows underneath the erosion control blocks, through the apertures in the blocks and between the blocks. This water flow occurs both under normal water flow conditions and when the water forms waves that break over the erosion system.

Hydrostatic pressure causes failures in concrete linings and erosion systems which do not have adequate open area. Under water flow conditions, the water flow across the top of the blocks creates a low pressure area on the surface of the blocks forming a traction force that pulls water and material up through the open areas in the revetment. The open areas permit an equalization of pressure between the upper and lower planar surfaces of the block. Thus, the erosion system must have open area to relieve the hydrostatic pressure.

Typically the erosion control blocks rest on a filter fabric. Where the lower planar surface of the block engages the fabric, the block prevents water flow through that portion of the fabric and only the remaining open areas in the filter fabric are available for relieving hydrostatic pressure. The open area of the filter fabric typically is about 6 to 8% of its area. Prior art erosion control blocks generally have vertical apertures through the block to provide approximately a 20% open area through the erosion system. Thus, the total percentage of open area which is available for the water to flow though the erosion system is about 6 to 8% of the 20%.

The surface roughness of any erosion system varies, within narrow limits, from one another. The open areas through the block due to these vertical apertures increases the roughness along the upper surface of the block. As the roughness increases, the volumetric flow of the water through the water channel or revetment is reduced thereby requiring that the water channel be made larger to handle the required volume of water flow. Thus, it is a trade off between having a sufficient number of vertical apertures through the block to provide hydraulic relief and the increased roughness of the upper surface of the block which reduces the given volume of water flow through the channel.

The density of the concrete material for the blocks is generally constant for all systems. The unit weight is somewhat limited to the amount easily handled over a normal working period by manual labor. The mutual support of the adjacent blocks varies widely with each design.

The hydraulic design attribute that differs between the various systems is the effect of this mutual support afforded by the adjoining blocks in the matrix. Whether the blocks are cabled or are interlocking, the "initial friction" between the blocks is the only force imparted by the adjacent blocks. Cables, that are in most cases in round channels, give no resistance to initial uplift of the blocks. The factor that is significant, and varies between systems, is the lineal length of surface in mutual contact as a proportion of the unit size of block. For instance a keyed or interlocked block has more contacting surface than a square block of the same height and weight. A typical problem with the dependency on this friction is the fact that a lot, and maybe most, of the applications of these systems are not on regular flat planes, there generally being humps and hollows and it is no more possible to conform to these features with fixed horizontal dimensions than to wrap a sheet of paper around a ball, without tears or creases. The practical problem for designers is that testing of the blocks are conducted in a flume with regular dimensions, yet site conditions seldom emulate the test conditions because the blocks must be cut and sized to fit the bends and abrupt changes of direction in the water channel since water channels do not have regular dimensions or directions.

It is generally accepted, that it is less expensive to manufacture block systems by means, of existing concrete masonry block plants than by wet casting. The large majority of, and the only widely available, concrete masonry production facilities utilize a production module that is designed to produce three standard concrete block masonry units. This module is typically 24 inches by 16 inches. The cost of producing an erosion control block is dominated by the production yield, in useful square area, per cycle of this production module, through the block machine. The block system that gets the most yield per cycle is going to be less expensive per unit of applied area of system. Interlocking systems generally get less yield per cycle. Cable systems that are not keyed get more yield, but require the blocks to have a number of holes running horizontally through the center. This requires special equipment and slows the production cycle time, largely off-setting the yield advantage.

To produce horizontal grooves along the bottom of the block in a horizontal production mold is difficult because it is difficult to get the blocks out of the production module. One would have to slide the blocks off the production module across the grooves requiring the block to ride up and over the forms on the bottom of the production module.

The present invention overcomes the deficiencies of the prior art.

SUMMARY OF THE INVENTION

The present invention is an erosion control system having a plurality of erosion control blocks connected to one another by connectors to form an interconnected network of erosion control blocks conforming to the underlying terrain for erosion prevention. Each erosion control block includes a plurality of apertures therethrough each forming a side wall. The connector includes a base with projecting first and second legs for insertion into the apertures of adjacent erosion control blocks. Each leg attachingly engages the side wall of the aperture of an erosion control block for connecting that erosion control block to an adjacent erosion control block. The legs have tapered extensions which frictionally engage the side wall. In one embodiment, the side wall includes a shoulder which engages the terminal end of the tapered extension on the leg. The connector is flexible allowing the adjacent erosion control blocks to articulate with respect to one another. Also, the connector may be made of metal so as to clip the adjacent control members together. The base of the connector may include a cable channel for passing a cable between the connector and erosion control block and the connector may also include a spacer on the base for spacing adjacent erosion control blocks a predetermined distance apart. The erosion control blocks may be of various shapes such as hexagonal, rectangular, or triangular. In one embodiment, the erosion control block includes one end having a convex arcuate surface and another end having a concave arcuate surface for providing an articulating joint between adjacent erosion control blocks. Further, in generally rectangular blocks, a plurality on horizontal hydraulic grooves are provided on the bottom planar surface of the blocks to enhance water flow beneath the blocks to the vertical apertures or vertical spaces between the blocks to provide relief from hydrostatic pressure.

One advantage of the present invention is the erosion control system securely fixes each block so that it is completely restrained in the vertical direction by all the adjacent blocks while allowing complete flexibility between the blocks. Because of the flexible connector, the system can stretch and shrink without compromising the integrity of the vertical restraint. This allows the system to expand and contract in the horizontal direction to accommodate variations from the flat plane.

A further benefit of the present invention is the ability to utilize the fall capacity of the concrete block production module. There is no space wasted for providing interlocks or keys. The open area that is required and necessary, for hydraulic pressure relief, with prior art systems is provided by the present invention in the spacing apart of the blocks. The net result is a yield in excess of the area of the production module as the spaces are a productive part of the system.

To provide for the occasions that require the system of the present invention to be laid in deep water, the present system will accept the necessary cables within the interconnecting connector, therefore removing the need and cost of forming horizontal holes through the concrete block. In addition, as the concrete blocks are permanently fixed together there is no need for the cables once the revetment is in place. The cables can therefore be less expensive, not being required to endure, or can be recovered and reused.

The present invention also provides horizontal hydraulic grooves for horizontal relief to hydrostatic pressure and relies less on a vertical relief.

BRIEF DESCRIPTION OF THE DRAWINGS

For a further understanding of the nature and objects of the present invention, reference will now be made to the following detailed description, taken in conjunction with the accompanying drawings, in which like parts are given like reference numerals and wherein.

DESCRIPTION OF PREFERRED EMBODIMENT

Figure 1:
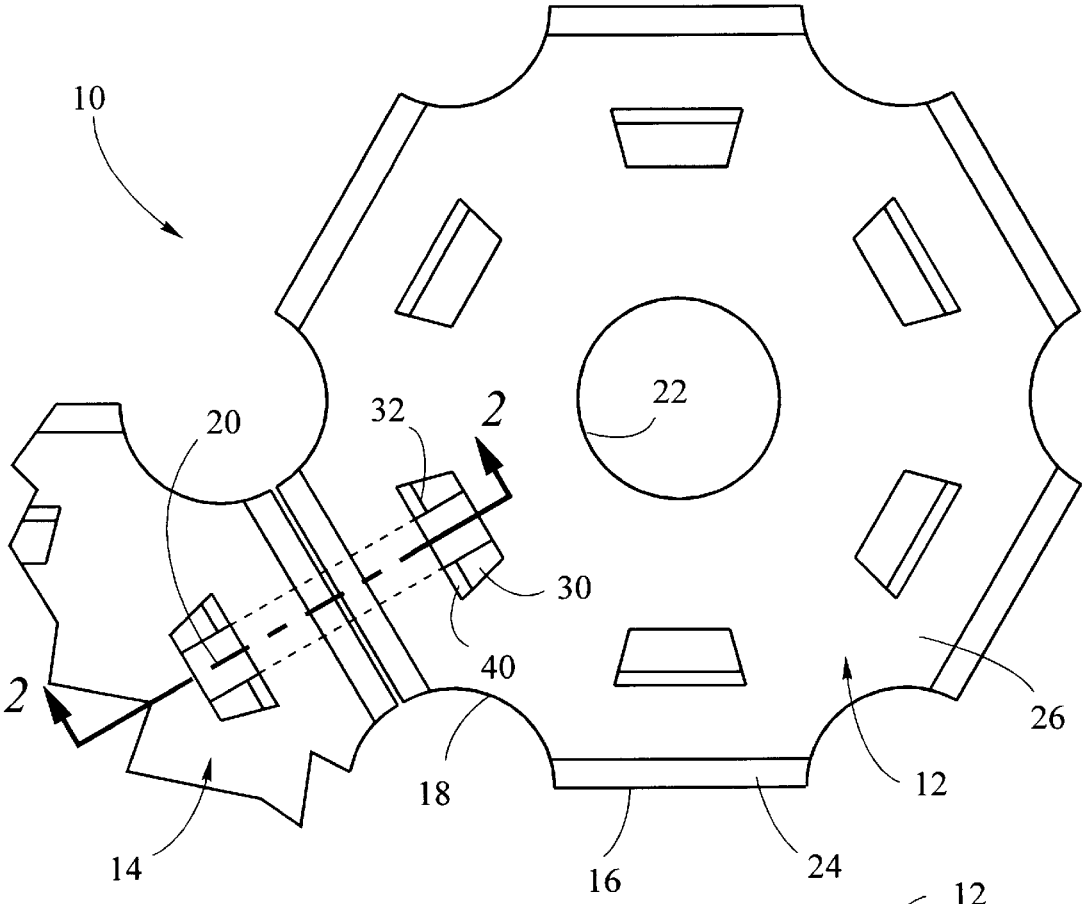
FIG. 1 is a plan view of adjacent hexagonal shaped soil erosion prevention blocks attached together by a connector.
Figure 2:
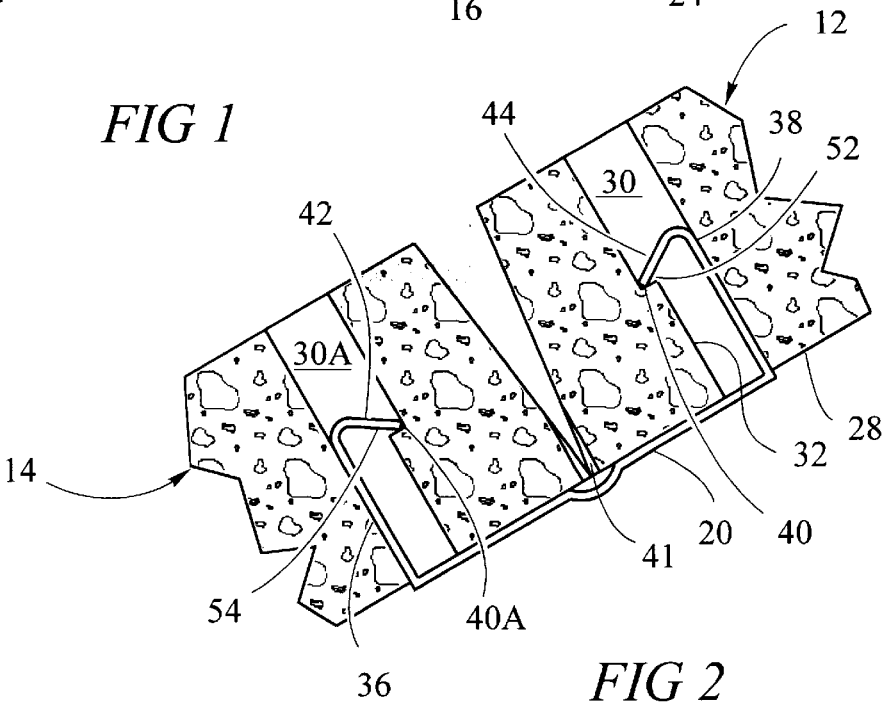
FIG. 2 is a cross-sectional view at plane A-A of FIG. 1 illustrating the connector attached to adjacent blocks.

Referring initially to FIGS. 1 and 2, the erosion control system 10 includes a first soil erosion prevention block 12 connected to a second soil erosion prevention block 14 by a connector 20. Soil erosion prevention blocks 12, 14 are preferably identical and therefore a description of soil erosion prevention block 12 will likewise describe other adjacent soil erosion prevention blocks such as block 14. Although soil erosion prevention block 12 is shown in the shape of a hexagon, it should be appreciated that the soil erosion prevention blocks of the present invention may be of any shape.

Soil erosion prevention block 12 includes upper and lower generally co-planar and preferably parallel top and bottom surfaces 26, 28, respectively, which terminate at a peripheral terminal side wall. The hexagonal shape forms hexagon side walls 16 preferably separated by open, arcuate recesses 18. A bore 22 is preferably provided through the center of block 12. Center bores 22, together with recesses 18 which form open bores upon assembly of adjacent blocks, allow natural vegetation to grow through the blocks thereby enhancing erosion control and aesthetics. These vertical bores 18, 22 also allow hydrostatic flow through the block as well as allowing the growth of vegetation therethrough which enhances the anchoring of the block in its final position. Each side wall 16 may also be tapered at 24 between co-planar surfaces 26, 28 of block 12.

A connector aperture or channel 30 is spaced adjacent and a pre-determined distance inwardly of each side wall 16. Connector aperture 30 extends from upper co-planar surface 26 to lower co-planar surface 28. A reduced dimension is provided at 32 to form an outer shoulder or shelf 40. The cross-sectional shape of connector aperture 30 may be of any variety of shapes which will accommodate the particular connector 20 which is to be used to connect adjacent blocks 12, 14.

Figure 3:
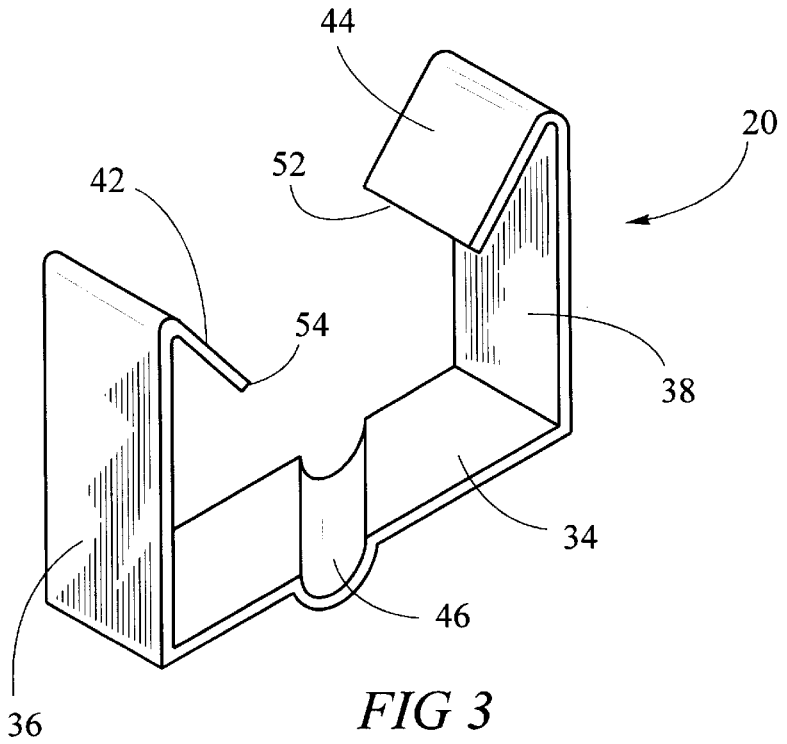
FIG. 3 is a perspective view of the connector shown in FIGS. 1 and 2.
Figure 4:
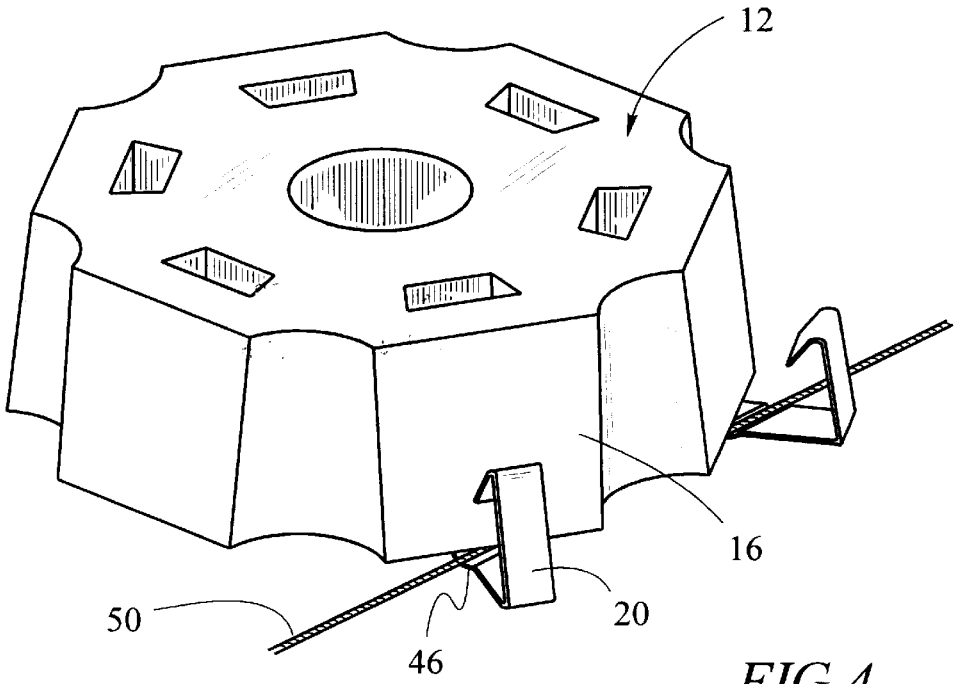
FIG. 4 is a perspective view of the hexagonal soil erosion prevention block of FIG. 1 illustrating a cable passing through the connectors.

Referring now to FIGS. 2–4, connector 20 is shown as a clip formed from a flat piece of elongated metal, such as spring steel, and bent into a generally inverted U shaped member. Connector 20 includes a base 34 with two upwardly projecting legs 36, 38. The terminal ends 42,44 of legs 36,38, respectively, are bent and tapered inwardly at an angle such as approximately 45 degrees. As shown in FIG. 4, base 34 may include a cable channel 46 for receiving a cable 50 for supporting soil erosion prevention block 12.

Figure 23:
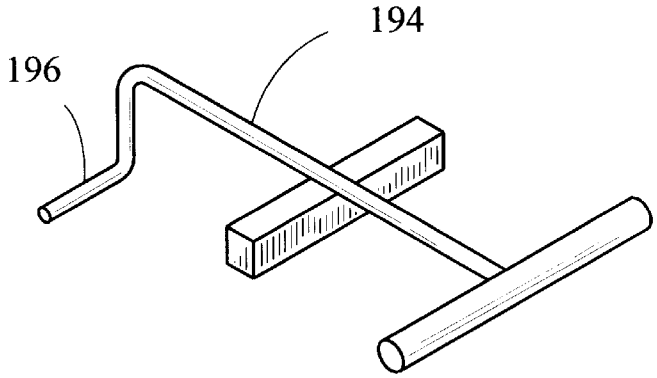
FIG. 23 is a perspective view of an installation tool for installing connectors.

In connecting adjacent blocks, 12, 14, as best shown in FIG. 2, leg 38 of connector 20 is inserted through the lower end of connection aperture 30 in block 12. Tapered terminal end 44 is then lifted upwardly by a tool such as shown in FIG. 23 until its free terminal end 52 engages upwardly facing shelf 40 of block 12. Likewise, leg 36 is inserted into the bottom of connector aperture 30A in soil erosion prevention block 14 and tapered terminal end 42 is lifted upwardly until its free terminal end 54 engages shelf 40A in block 14. As can be appreciated, connector 20 has a certain amount of elasticity allowing it to flex and bend with relative positions of blocks 12,14. This is particularly true as blocks 12, 14 articulate with respect to one another when lifted and transported on cables 50.

Figure 5:
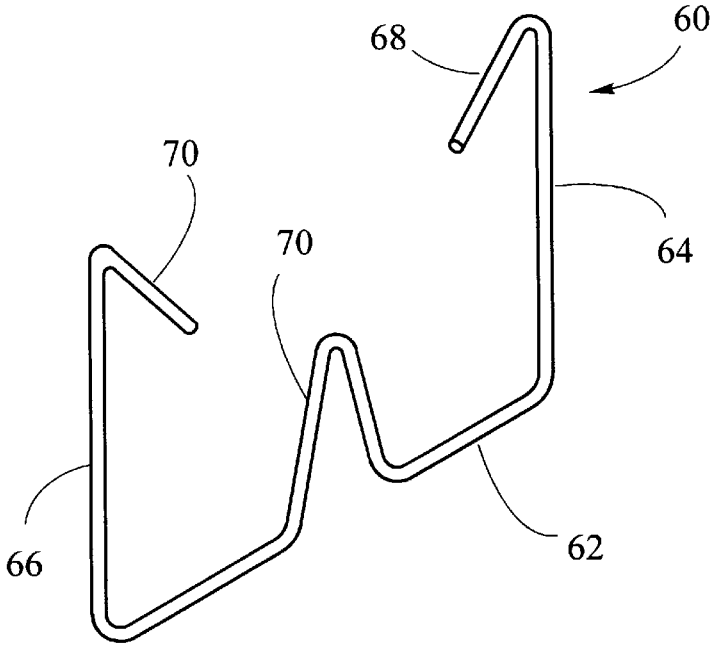
FIG. 5 is a perspective view of a connector similar to that shown in FIG. 3 but made of wire.

Referring now to FIG. 5, there is shown a wire connector 60 which is an alternative embodiment to connector 20 shown in FIG. 3. Wire connector 60 is made of wire rather than an elongated piece of metal. The wire connector 60 is generally U shaped having a base 62 and two upwardly projecting legs 64, 66. The terminal ends 68, 70 of legs 66, 64 are tapered inwardly and downwardly. Although base 62 may include a cable channel, base 62 of connector 60 is shown with a spacer 70. Spacer 70 includes an upwardly extending inverted V shaped portion in base 62 for engaging side wall 16 of adjacent blocks for spacing adjacent blocks apart, when desired.

Figure 6:
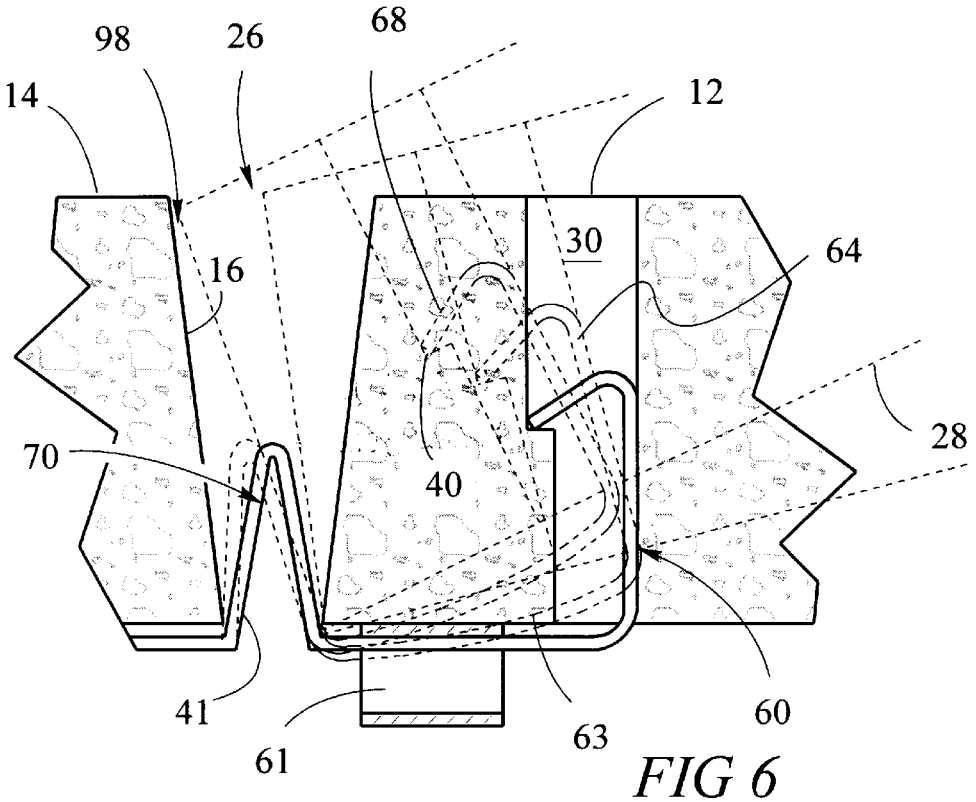
FIG. 6 is a side elevation view of the wire connector shown in FIG. 5 connecting adjacent soil erosion prevention blocks and including a spacer inbetween.

Referring now to FIG. 6, there is shown the installation of wire connector 60 in soil erosion prevention blocks 12, 14. The legs 64, 66 of wire connector 60 may be angled inwardly such that first leg 66 is inserted in channel aperture 30A of block 14 such that terminal tapered end 42 engages shelf 40A. The lower corner formed by side wall 16 and bottom surface 28 of block 12 may be chamfered at 41 (See FIG. 2) for matingly engaging spacer 70 of wire connector 60. Block 12 is then pivoted as shown in phantom lines in FIG. 6 until the upper corner 98 formed by side wall 16 and top surface 26 engage side wall 16 of block 14 thereby allowing the insertion of leg 64 of connector 60 into channel aperture 30 of block 12. Upon the engagement of terminal tapered end 68 onto outer shelf 40, block 12 is then pivoted downwardly into the position shown in solid lines in FIG. 6. In this type of installation, wire connector 60 provides a constant engaging tension by tapered ends 68, 70 on shelves 40, 40A of blocks 12, 14, respectively, due to the spring force of connector 60. A wire connector will be cheaper to manufacture because it can be made of wire stock and can be bent easily.

Also shown in FIG. 6, wire connector 60 includes a cable ferrule or ring 61. Ring 61 is threaded over wire connector 60 and disposed around the base 63 of connector 60. Ring 61 may be a piece of pipe.

Figure 7:
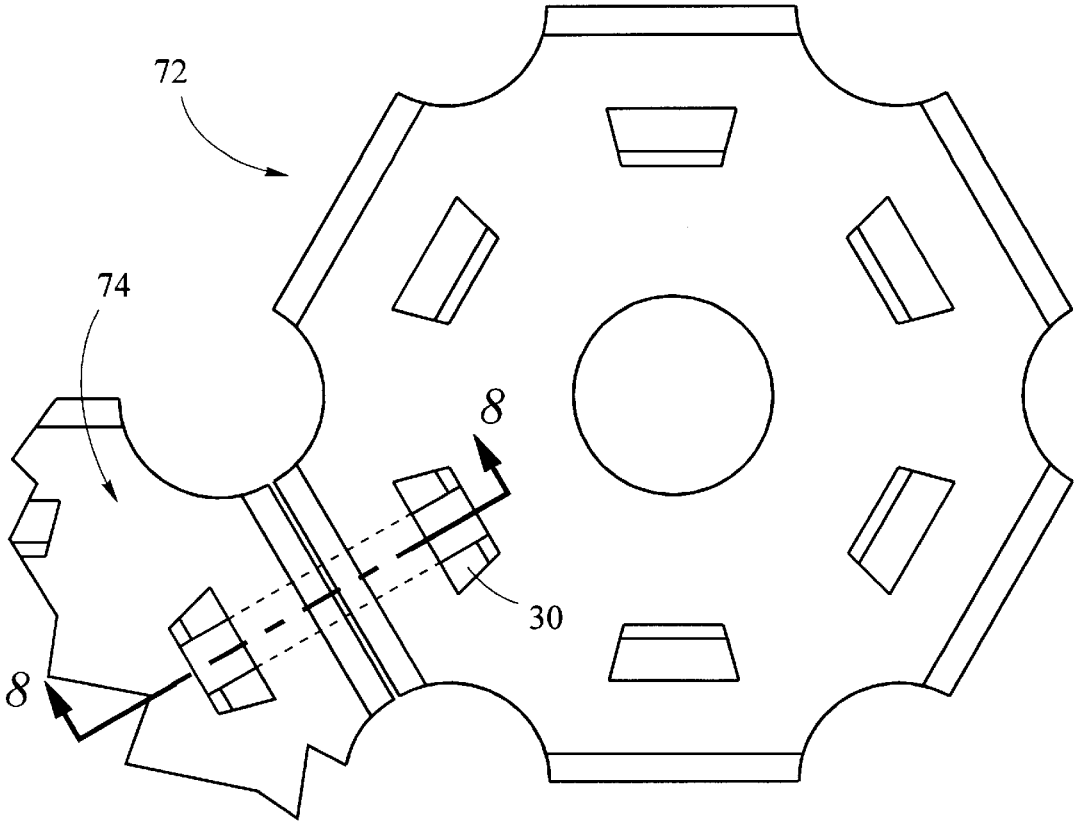
FIG. 7 is a plan view of another embodiment of the soil erosion prevention blocks and connector shown in FIG. 1.
Figure 8:
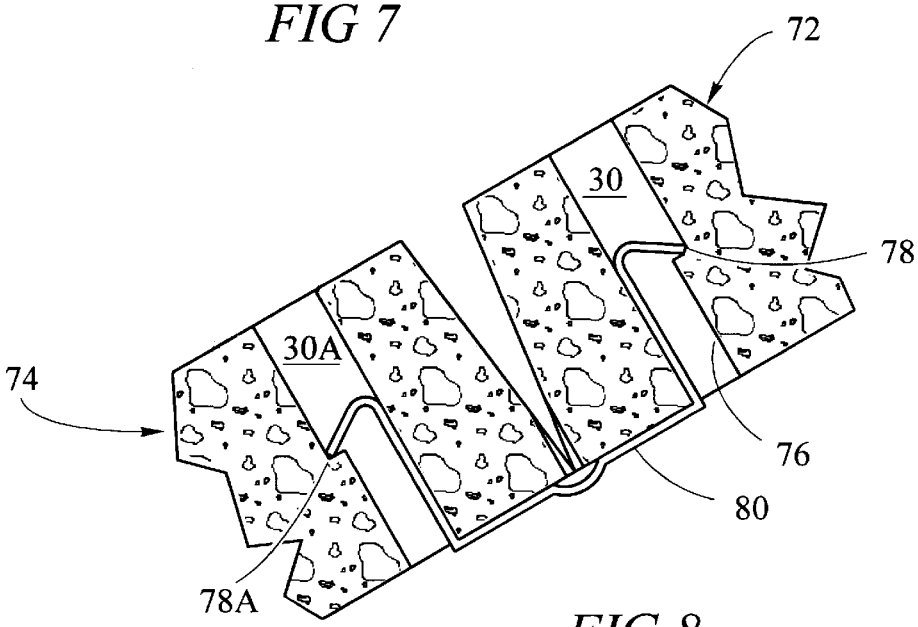
FIG. 8 is a cross-sectional view at plane A-A shown in FIG. 7 showing the connector connecting adjacent blocks.
Figure 9:
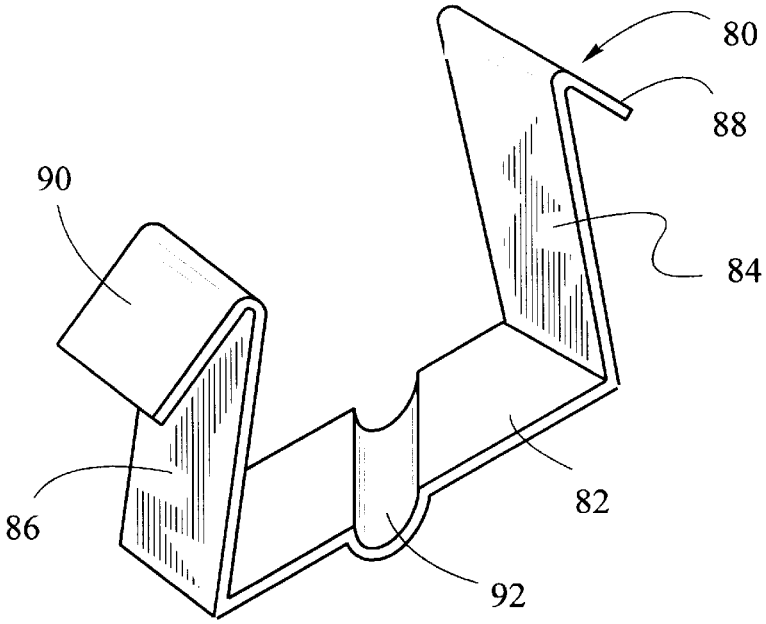
FIG. 9 is a perspective view of the connector shown in FIGS. 7 and 8.
Figure 10:
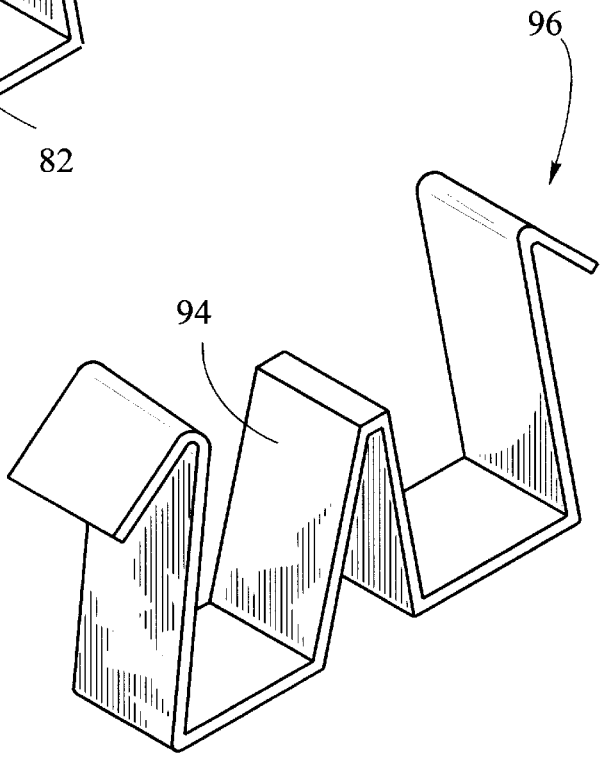
FIG. 10 is a perspective view of a connector similar to that of FIG. 9 but including a spacer.
Figure 11:
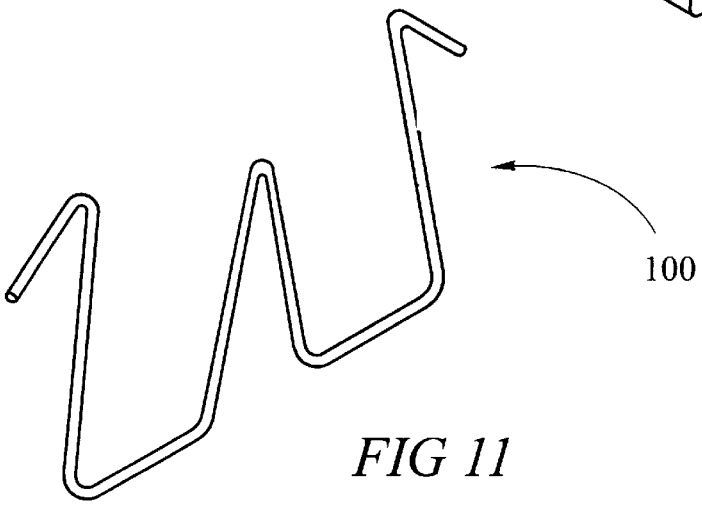
FIG. 11 is a perspective view of a connector similar to that shown in FIG. 10 but made of wire.

Referring now to FIGS. 7–9, there is shown a slightly modified soil erosion prevention block 72 which is substantially the same as soil erosion prevention blocks 12,14 in FIG. 1 with the exception that channel aperture 30 includes an enlarged dimension at 76 to form an inner shoulder or shelf 78. A connector 80 is used with block 72 and includes a base 82 with upwardly projecting legs 84, 86. Upwardly extending legs 84, 86 include outwardly and downwardly tapering terminal ends 88, 90, respectively, adapted for engaging inner shelves 78 and 78A in channel apertures 30 and 30A of blocks 72, 74. As shown in FIG. 10, the cable channel 92 shown in base 82 of connector 80 may be substituted with a spacer 94 in connector 96. Also, as shown in FIG. 11, the connector 80 may be made of wire such as connector 100.

Figure 12:
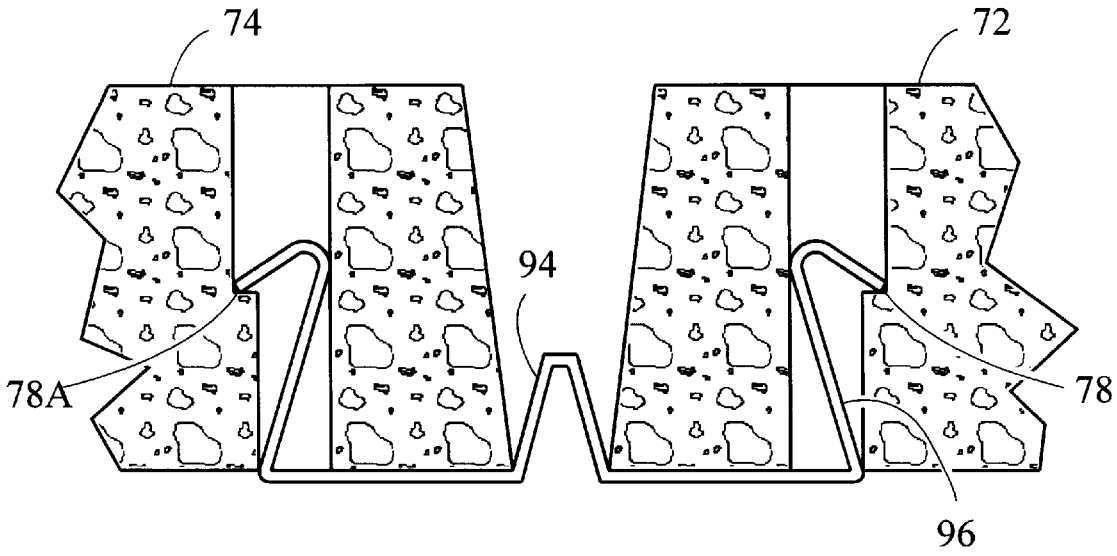
FIG. 12 is a cross-sectional view of a connector with outwardly directed terminal tapered ends for connecting adjacent soil erosion prevention blocks having inner shelves.
Figure 13:
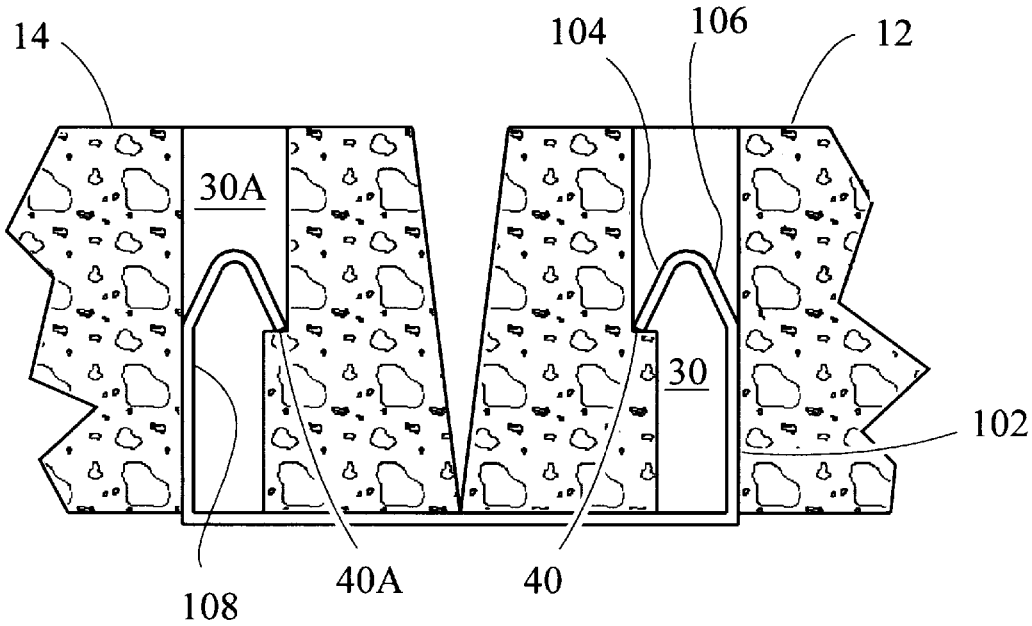
FIG. 13 is a cross-sectional view of a connector with inwardly directed terminal tapered ends for connecting adjacent soil erosion prevention blocks having outer shelves.

Referring now to FIGS. 12 and 13, there is shown in FIG. 12 blocks 72, 74 connected by connector 96 having spacer 94 in between and there is shown in FIG. 13 a connector 102, similar to connector 20, connecting adjacent blocks 12, 14. Connector 102 does not include a cable channel and shows a variation in the inwardly and downwardly terminal tapered ends 104 by including an inwardly and upwardly angled upper section of legs 108. As can be seen in FIG. 13 no spacer is provided between adjacent blocks 12, 14. The base of the connectors are dimensioned to allow stretch between adjacent blocks on either connector 96 or connector 102. It should also be appreciated that the described connectors may also be made of plastic.

Figure 14:
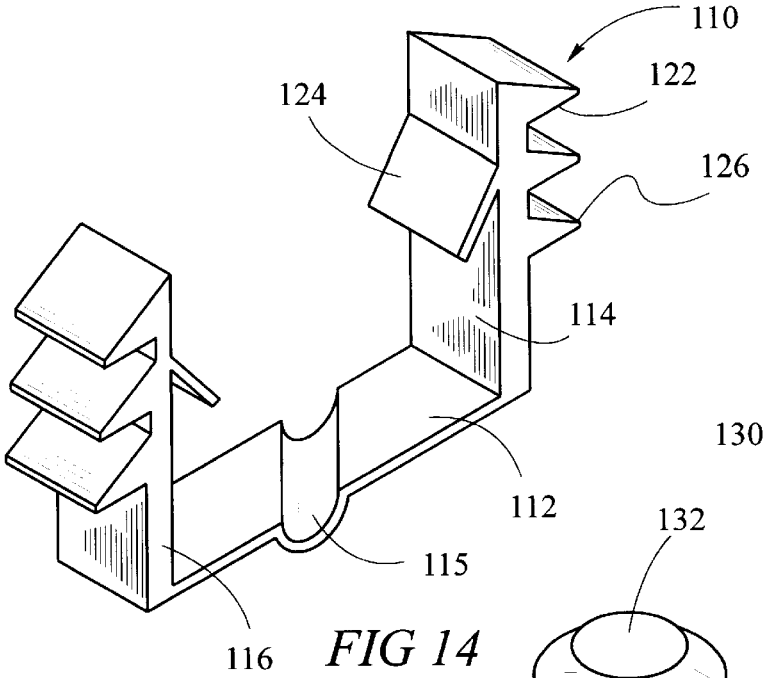
FIG. 14 is a perspective view of an alternative connector.
Figure 15:
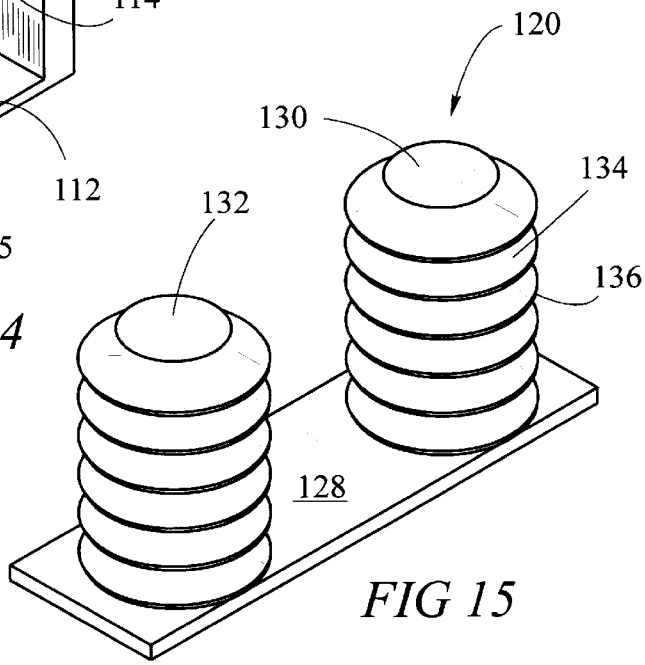
FIG. 15 is a perspective view of a still another alternative connector.

Referring now to FIGS. 14 and 15, there are shown friction fit connectors as an alternative embodiment to the clip connectors previously described. Friction fit connectors avoid the requirement of a shelf in the channel aperture of the blocks. FIG. 14 illustrates friction fit connector 110 for use in generally rectangular channel apertures. Friction fit connector 110 is generally U shaped and includes a base 112 with upwardly projecting legs 114, 116. Base 112 is shown having a cable channel 118. Connector 110 is preferably made of plastic or other flexible material for engaging the interior walls forming the channel aperture. Each leg 114, 116, includes a plurality of outwardly extending and downwardly tapering wing like flanges 122 and at least one inwardly directing wing like flange 124. The terminal ends 126 of wing like flanges 122, 124 are deformed upon insertion into the channel aperture so as to frictionally and grippingly engage the interior walls of the apertures of soil erosion prevention blocks. FIG. 15 illustrates another embodiment of the friction fit connector 120. Friction fit connector 120 is particularly designed for use in soil erosion prevention blocks which include a round aperture. Connector 120 includes a generally rectangular base 128 having a pair upwardly projecting legs 130, 132. Legs 130, 132 include a plurality of outwardly and downwardly extending disc like members 134 whose terminal ends 136 frictioningly engage the interior walls of a round aperture in soil erosion prevention blocks.

Figure 16:
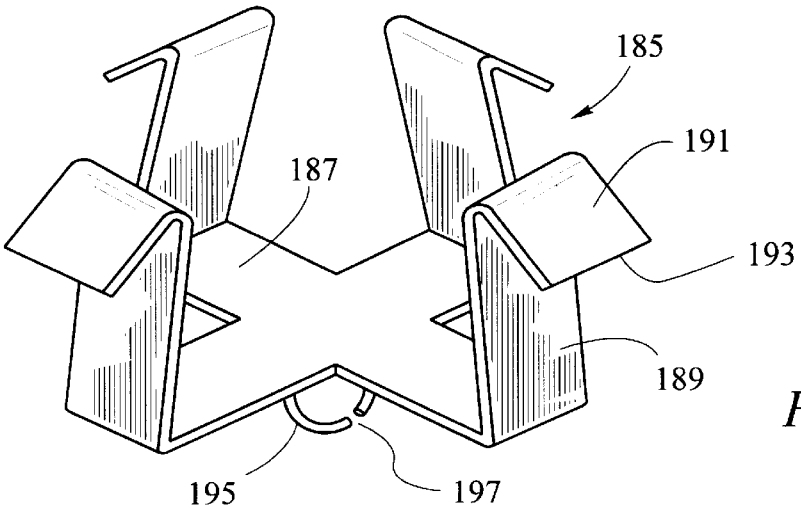
FIG. 16 is a perspective view of a multi-block connector.
Figure 17:
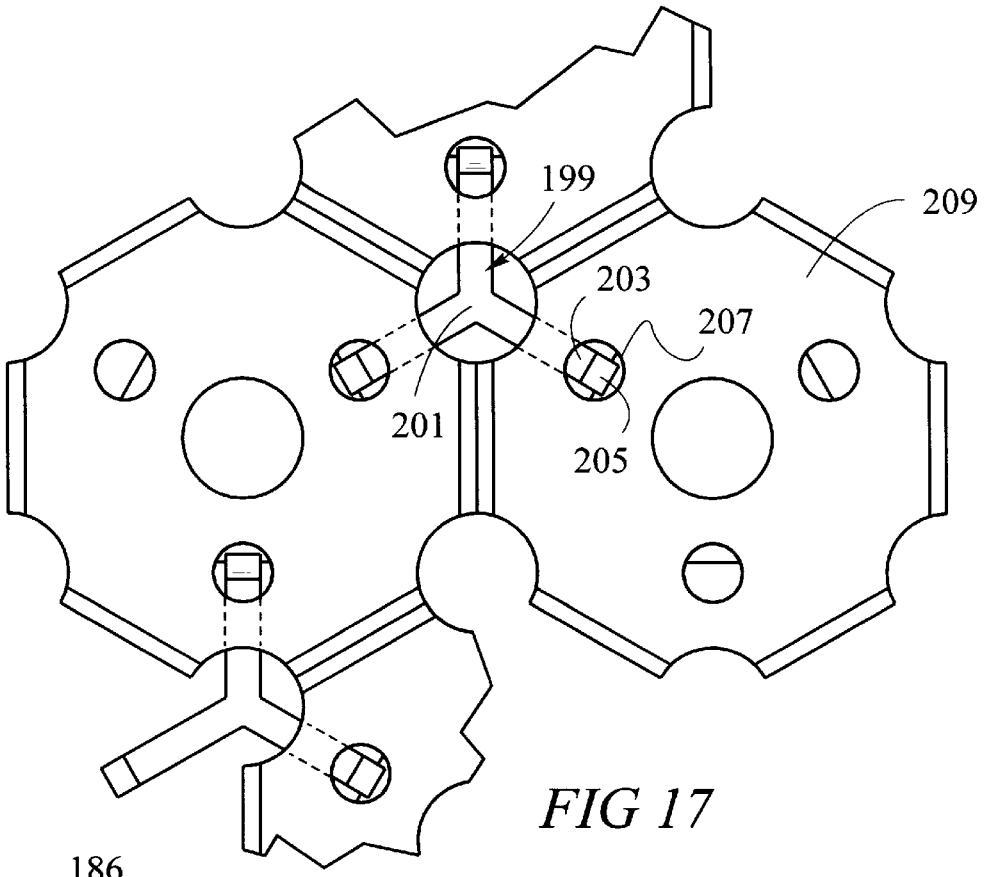
FIG. 17 is a plan view of a plurality of interconnected soil erosion prevention blocks using a multi-block connector similar to that shown in FIG. 16.

Referring now to FIGS. 16 and 17, there are shown connectors for connecting three or more soil erosion prevention blocks . Referring particularly to FIG. 16, there is shown a multi-block connector 185 preferably made of plastic such as ABS plastic, high density polyethylene, or polypropylene. The multi-block connector 185 includes a base 187 having four upwardly projecting legs 189. Each leg 189 preferably includes an outwardly extending and downwardly tapering flange 191 having a terminal end 193 adapted for engagement with a shelf on the soil erosion block. The multi-block connector 185 may also include a cable ring 195 molded on the lower surface of base 187. The molded cable ring 195 may be an incomplete ring having an opening 197 which is slightly smaller than the diameter of a cable. For example, if a ⅜" cable were to be used, the opening 197 will be approximately one quarter inch. In installation, the cable would be pressed through the opening 197 and into cable ring 195. It should be appreciated that cable ring 195 may be a complete ring through which the cable is threaded.

Referring now to FIG. 17, there is shown a multi-block connector 199 having a base 201 and three upwardly projecting legs 203. Each leg 203 includes a tapered flange 205 which engages shelf 207 of block 209. Connector 199 is used to connect three blocks as compared to connector 185 of FIG. 16 which connects four blocks.

Figure 18:
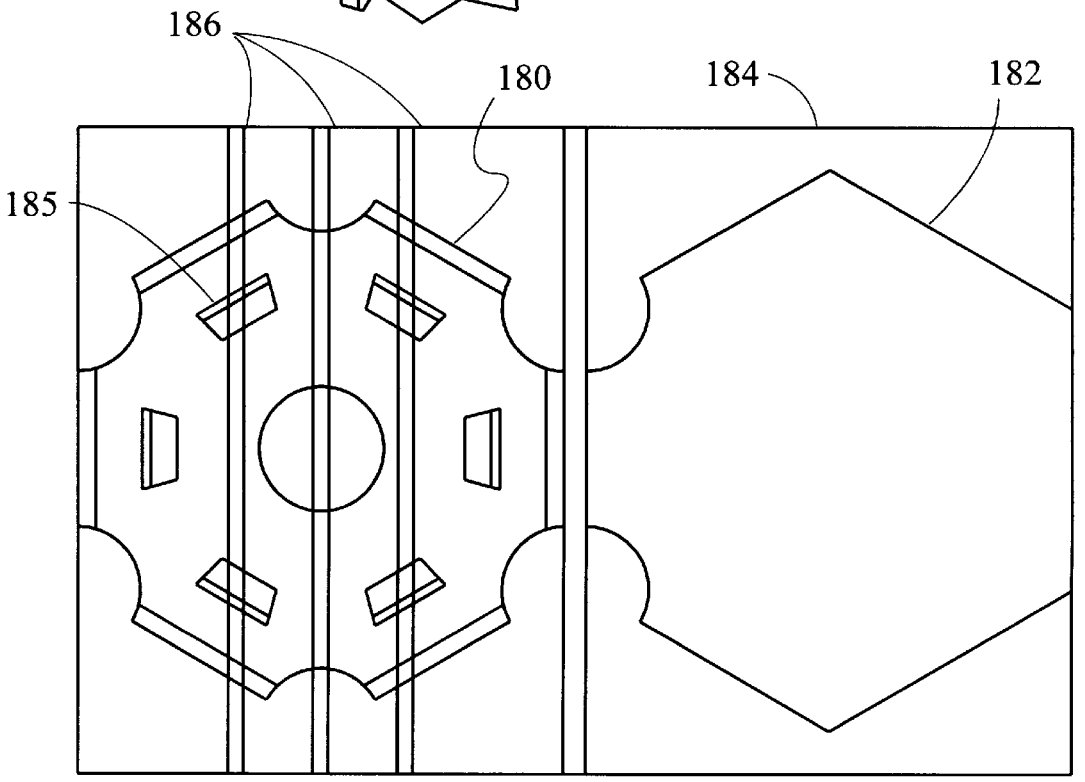
FIG. 18 is a plan view of a production module for hexagonal shaped soil erosion prevention blocks.

Referring now to FIG. 18 the hexagon shaped soil erosion prevention blocks 180, 182 are shown being produced in a production pallet or module 184 which is 24 inches long and 16 inches wide. The cost of producing an erosion control block is dominated by the production yield, and useful square area, per cycle of the production module utilizing a block machine. The block system which achieves the greatest yield per cycle will produce the least expensive erosion control block per unit of applied area. The present invention allows the full utilization of the capacity of the concrete block production module 184. There is no space wasted to provide interlocks or keys. The open area that is required and necessary, for hydraulic pressure relief, with all other systems is provided by the connector of the present invention in the spacing apart of the blocks. The net result is a yield in excess of the area of the module 184 as the spaces are a productive part of the system. In addition, the connector of the present invention avoids the cost of forming horizontal holes through the concrete block for cables.

As shown in FIG. 18 three core bars 186 are provided through module 184 and vertical cores 188 are provided to form the channel apertures. As shown, two soil erosion prevention blocks 180, 182 can be produced inside the standard 24×16 module 184.

Figure 19:
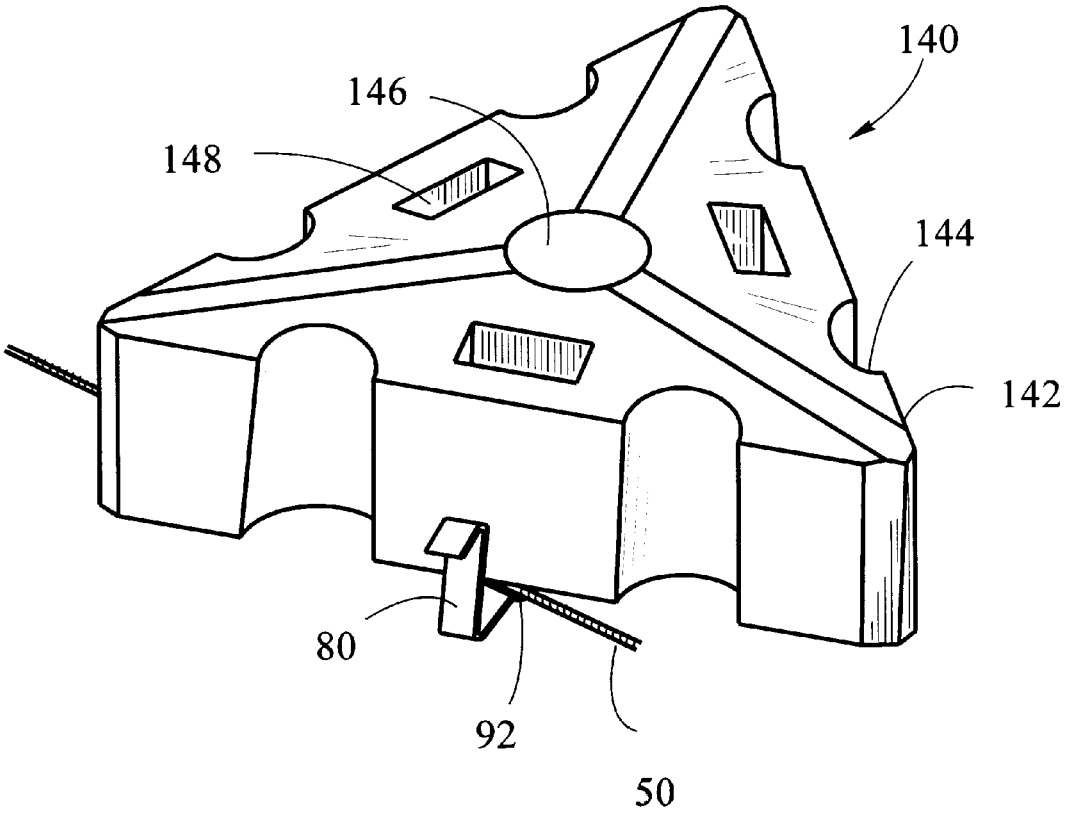
FIG. 19 is a perspective view of a triangular shaped soil erosion prevention block.

It should be appreciated that although soil erosion prevention blocks are shown with a hexagonal shape in FIGS. 1 and 7, the blocks may be of other preferred shapes. FIG. 19 illustrates a soil erosion prevention block 140 having a triangular shape. Block 140 includes side walls 142 having arcuate recesses 144. Block 140 also includes a central bore 146 and a channel aperture 148 adjacent each side wall 142 for receiving a connector, such as connector 80 shown in FIG. 9. A cable 50 is shown extending through cable channel 92 of connector 80.

Figure 20:
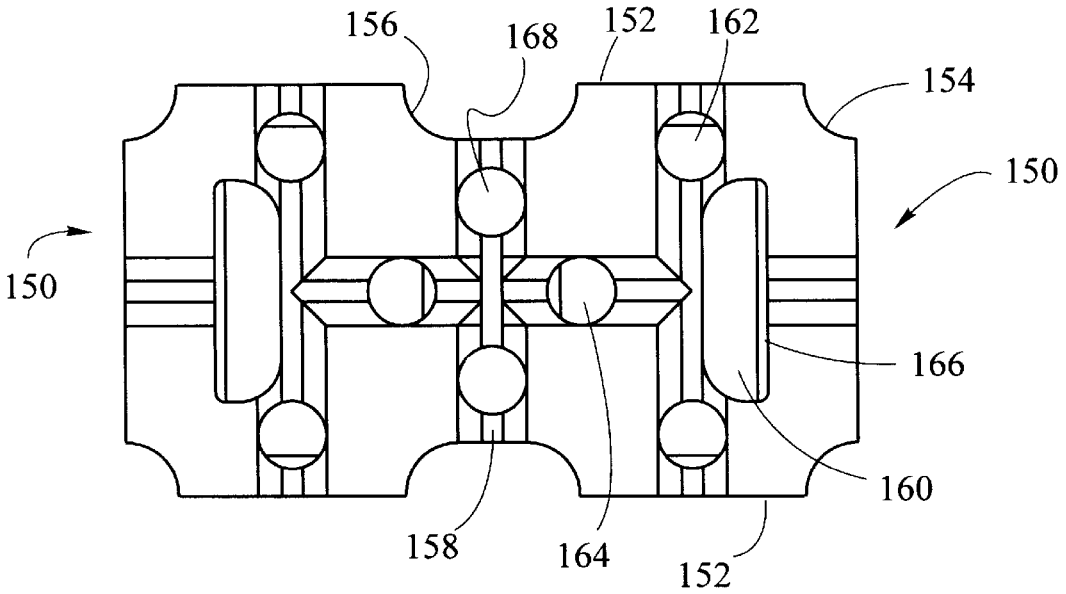
FIG. 20 is a plan view of a still another embodiment of the soil erosion prevention block.

FIG. 20 illustrates a rectangular shaped soil erosion prevention block 150. Block 150 includes end walls 150 and side walls 152. Arcuate recesses 154 are provided at the mating corners of walls 150, 152. Further, side walls 152 include an additional arcuate recess 156. Block 150 is provided with a break groove 158 which extends between arcuate side recesses 156 and across block 150. Break groove 158 allows block 150 to be broken into two halves. Enlarged channel apertures 160 are provided adjacent end walls 150 and round apertures 162 are provided proximate to side walls 152. Center apertures 164 are provided in case block 150 is broken into two parts. Apertures 160, 162, and 164 each include a shelf 166 for engaging one of the variety of connectors previously described. Center holes 168 also provided for the growth of vegetation and hydrostatic flow.

Figure 21:
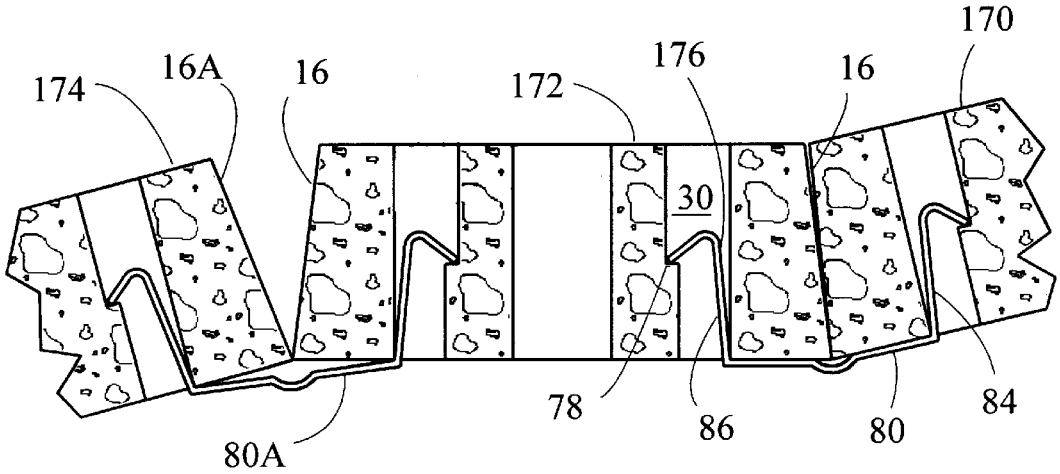
FIG. 21 is a cross-sectional view of a series of adjacent soil erosion prevention blocks conforming to an uneven underlying terrain.

FIG. 21 illustrates 3 adjacent soil erosion prevention blocks 170, 172, 174 resting on a downwardly extending and curved underlying soil surface. Connectors 80 and 80A are shown connecting blocks 170, 172 and blocks 172, 174, respectively. Connector 80 is shown in a concave flex position allowing the adjacent side walls 16 of blocks 170, 172 to be in contact. Connector 80A is shown in the convex flex position allowing side walls 16, 16A to be separated. It should also be appreciated, as shown in FIG. 21, that the legs 84, 86 of connector 80 may include inwardly and downwardly extending barbs 176 for engagement with the wall of aperture 30.

Figure 22:
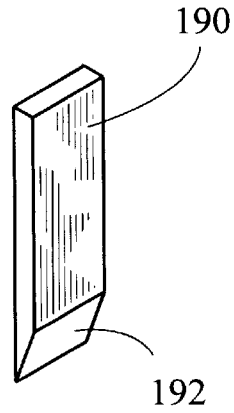
FIG. 22 is a perspective view of a wedge tool for releasing the connector.

Referring now to FIGS. 22 and 23, there are shown tools for installing and removing the connectors. FIG. 22 shows a wedge tool 190 having a lower wedge surface 192 for engaging the terminal tapered ends of the connector to force them inwardly and off of the shelf of the soil erosion prevention block. FIG. 23 illustrates an installation tool 194 which includes a formed end 196 which may be inserted beneath the terminal tapered ends of the connector for lifting them upwardly onto the shelf of the soil erosion prevention blocks.

Figure 24:
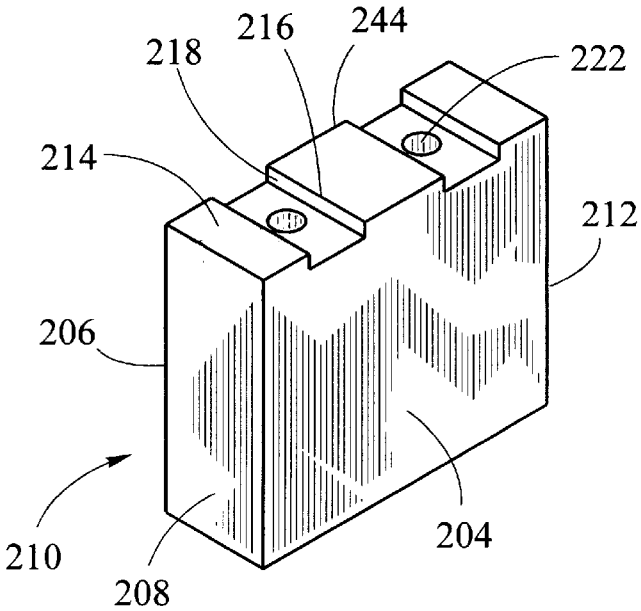
FIG. 24 is a perspective view of a still further soil erosion prevention block.
Figure 25:
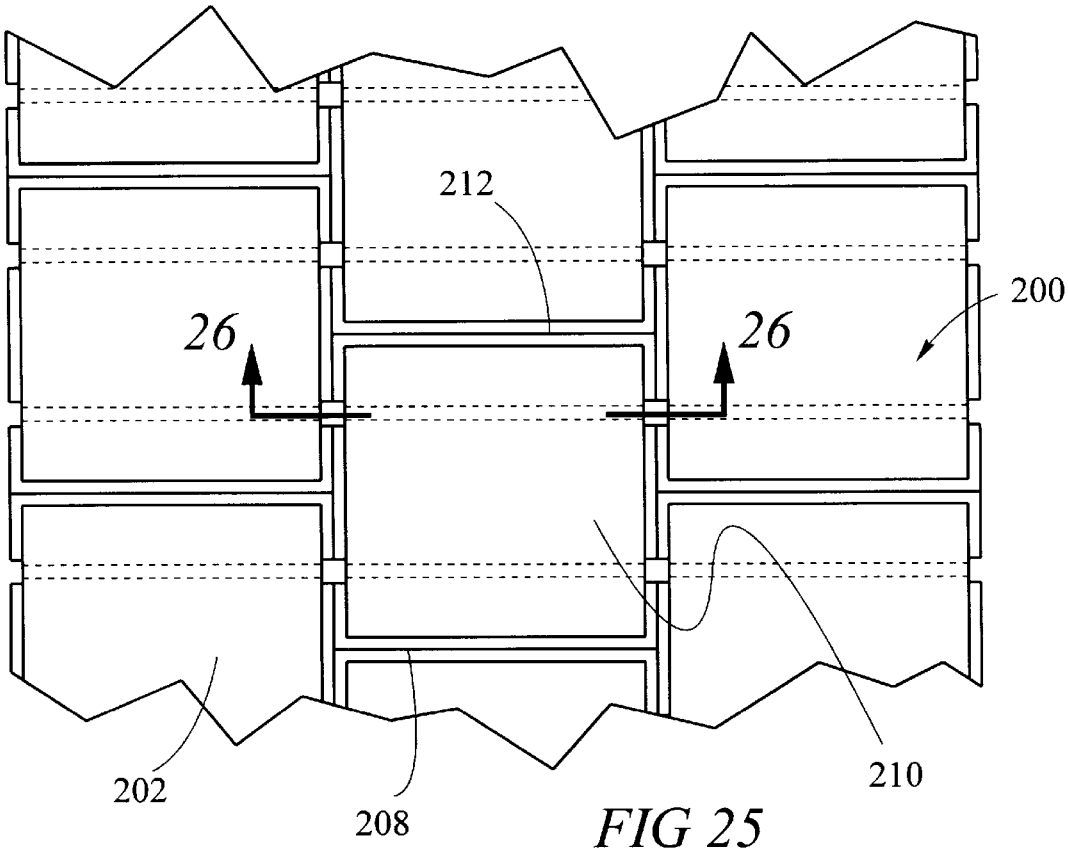
FIG. 25 is a plan view of a plurality of interconnected soil erosion prevention blocks like that shown in FIG. 24.
Figure 26:
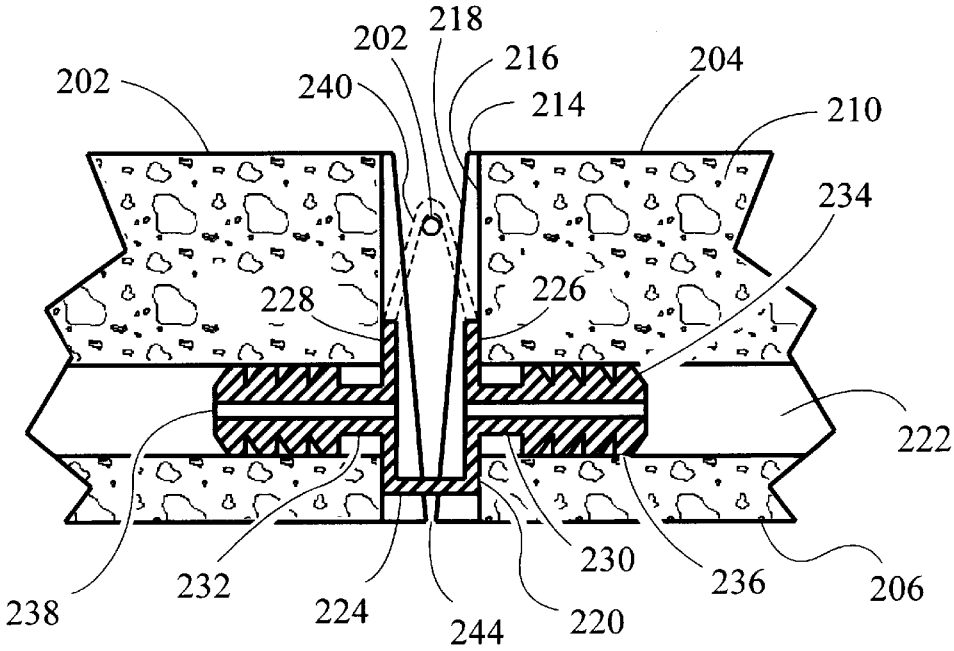
FIG. 26 is a cross-sectional view taken at plane A-A of FIG. 25 showing a horizontal connector attaching adjacent soil erosion prevention blocks.

Referring now to FIGS. 24–26, there is shown an alternative erosion control system 200 including a soil erosion block 210 with a connector 220 for connecting block 210 with adjacent soil erosion prevention block 202. Soil erosion prevention block 210 is generally rectangular having a maximum height of 12 inches and a length of either 12 inches or 16 inches. The thickness of the block 210 is designed to use the maximum depth of the block machine. The block 210 includes a top planar surface 204 and a bottom planar surface 206. It also includes end walls 208, 212 which are planar surfaces and side walls 214 on each side. Side walls 214 are preferably tapered as shown at 216 with a channel recess 218 for receiving connectors 220. A bore 222 extends through the width of block 210 between the recess channel 218 on one side wall 214 to a recess channel 218 on the opposite side wall 214. Bores 222 are sized to receive connectors 220.

As distinguished from the embodiments of FIGS. 1–23, the connector 220 for soil erosion prevention system 200 is horizontal rather than vertical. Connector 220 includes a central U shaped portion forming a base 224 with upwardly projecting legs 226, 228. Connector grommets or posts 230, 232 project outwardly from legs 226, 228, respectively. Posts 230, 232 include a plurality of annular disc like members 234 whose annular terminal ends 236 flex and frictionally engage the interior wall surface forming bore 222 after insertion. Connector 222 is preferably made of plastic thereby allowing disc like members 234 to flex within bore 222. The connector 220 includes a stretch/compress feature by forming an accordion bridge between the fixing grommets 230, 232 due to the new shape. The accordion bridge design frictionally fits within the bores 222. Further, connector 220 includes a horizontal bore 238 which extends through posts 230, 232 for receiving a cable if desired. Also, it should be appreciated that legs 226, 228 may extend to form an inverted upper V shape 240, shown in phantom lines, through which a cable 242 may be inserted.

As best shown in FIG. 25, the end surfaces 208, 212 of block 210 engage adjacent blocks. The side walls 214 engage adjacent blocks, such as block 202, with the base 244 of tapered portion 218 abutting the complimentary base of the adjacent block.

Figure 33:
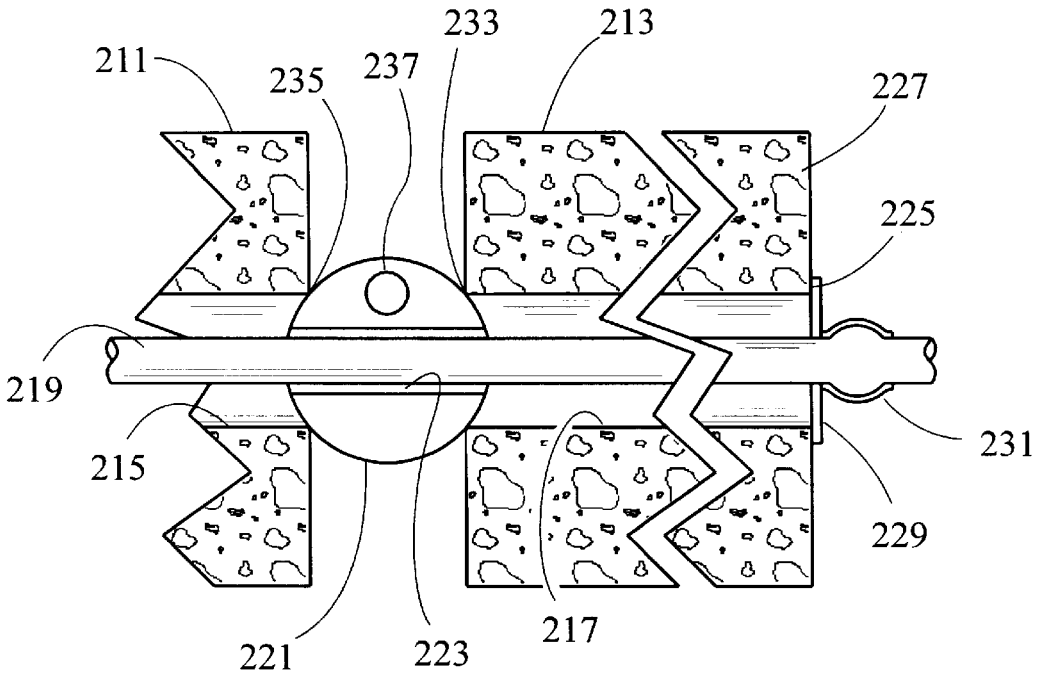
FIG. 33 is a cross-sectional view of two adjacent soil erosion prevention blocks connected by cable and spaced apart by a spherical spacer.
Figure 34:
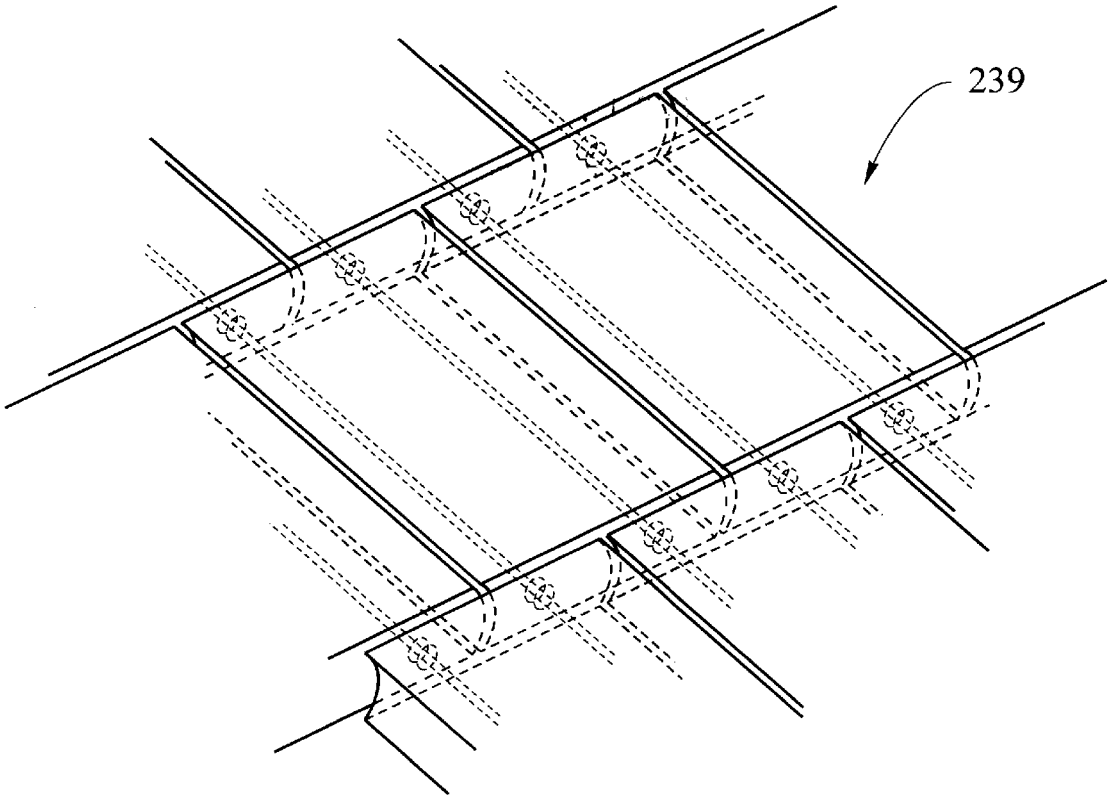
FIG. 34 is a perspective view of a plurality of soil erosion prevention blocks connected together with the cable and spacer assembly shown in FIG. 33.

Referring now to FIGS. 33 and 34, there is shown an alternative method and assembly for connecting and spacing adjacent soil erosion blocks 211, 213. Soil erosion blocks 211, 213, include apertures 215, 217, respectively, therethrough for receiving a cable 219. An interspacing plastic sphere 221 is disposed between adjacent blocks 211, 213 by passing cable 219 through an aperture 223 extending through sphere 221. Cable 219 is threaded through apertures 215, 223, and 217 and then secured at the outlet 225 of the outermost block 227 by means of a disk 229 covering mouth 225 and a cable crimp 231 around cable 219 which bears against disk 229. Cable 219 is tightened prior to setting cable crimp 231 thus drawing adjacent blocks 211, 213 together. Upon tightening cable 219, spheres 221 are partially drawn into apertures 217, 219 at 233,235, respectively to inhibit relative vertical movement between the blocks 211, 213. Blocks 211, 213, however, are still able to articulate by rotating about sphere 221. Sphere 221 may include an additional aperture 237 which is perpendicular to aperture 223 such that a hoisting cable may be inserted through holes 237 to hoist the completed matrix of blocks during installation. Alternatively, a clip may be added to or included in the sphere to accept such hoisting cables. FIG. 34 illustrates a matrix 239 of soil erosion blocks using the securing and spacing assembly of FIG. 33.

Figure 27:
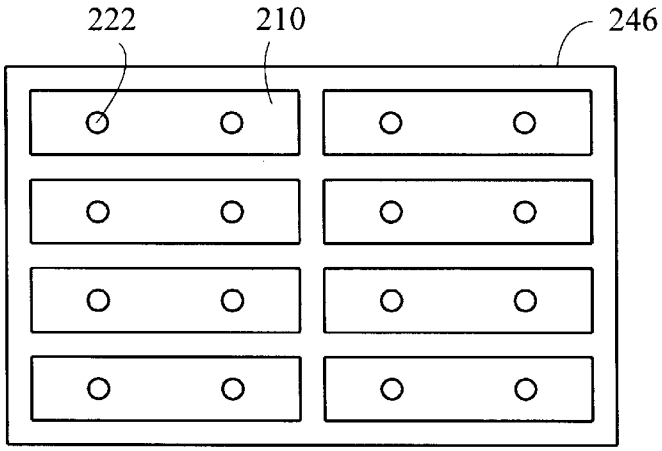
FIG. 27 is a plan view of a production module for producing the soil erosion prevention blocks shown in FIG. 24.

Referring now to FIG. 27, the block system 210 allows a large yield from a production cycle and will produce up to 8 square feet per block machine cycle. This is achieved by utilizing the maximum depth of the machine. There is no limitation of either the weight per cycle or the number of divisions. The only limitation is the module in plan and a maximum height of 12 inches. As shown in FIG. 27, the drawings of the standard concrete block module 246 allows the blocks to be made either with a length of 12 inches or 16 inches. As shown, the bores 222 used for horizontal fixity are all formed in a vertical direction and do not require any core-pullers or any other special equipment. If additional free area for hydraulic relief is required, then large cores can be used and pulled. This production yield is achieved because of the generally rectangular shape and smooth planar surface of the block as compared to the hexagonal or triangular shapes shown in FIGS. 4 and 17.

As each block has a bore 222 running horizontally through it, it is now easy to pass cables through the bores for installation underwater. It is unnecessary to employ expensive cable as they can now be abandoned or recovered once the system is in place.

Figure 28:
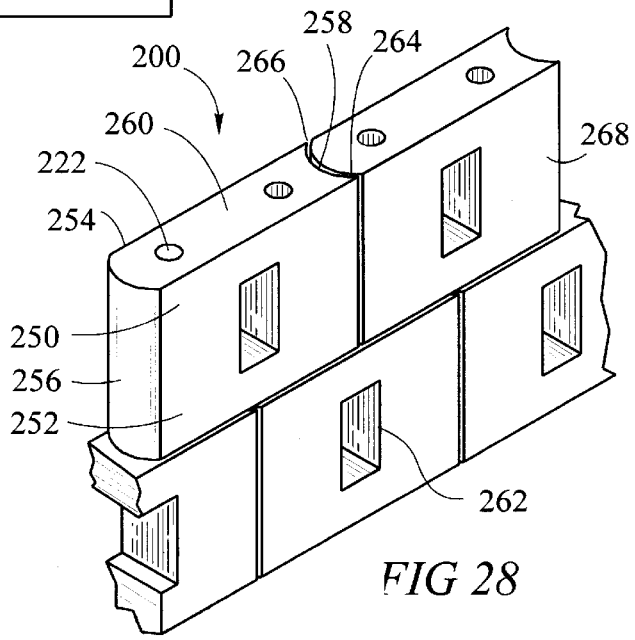
FIG. 28 is a perspective view of a still another embodiment of the soil erosion prevention block having arcuate ends.

Referring now to FIG. 28, there is shown soil erosion prevention system 200 utilizing an alternative soil erosion prevention block 250. Soil erosion block 250 is generally rectangular with an upper planar surface 252 and a lower planar surface 254. However, it also includes ends walls 256, 258 which are arcuate. The side walls 260 are generally flat and include the standard through bores 222 for receiving connectors 220. Also, center channel aperture 262 may be provided for hydraulic relief or for the growth of vegetation.

The arcuate end walls 256, 258 provide a bookend connection which allows the ends of blocks 250 to articulate and yet provides lips 264 and 266 which limit the vertical movement of adjacent block such as 268. The book end connection of soil erosion prevention system 200 sacrifices some yield but obviates the need to fix adjacent blocks in the vertical direction. The rows of blocks may be in line with the book end joints across the direction of flow. The stability will be without equal, especially if the block is made wedge shaped pointing into the flow. The flow passing over the overlap creates a vortex which exerts pressure on the overlapping lip 264 which holds down the underheld upstream end of the downstream block. The book end feature avoids any need to secure the blocks vertically.

Figure 29:
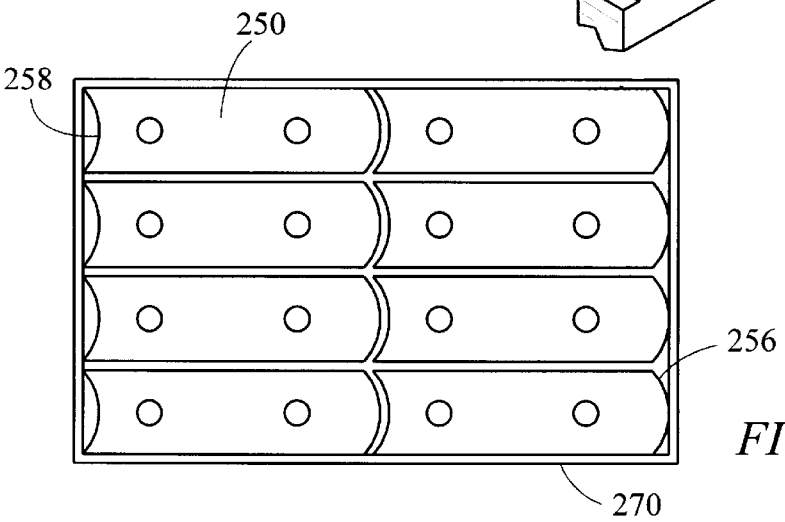
FIG. 29 is a plan view of a production module for producing the soil erosion prevention blocks shown in FIG. 28.

With respect to FIG. 29, there is shown blocks 250 being formed in a standard concrete block module 270. The book end feature due to the arcuate end walls 256, 258 sacrifices some yield.

Figure 31:
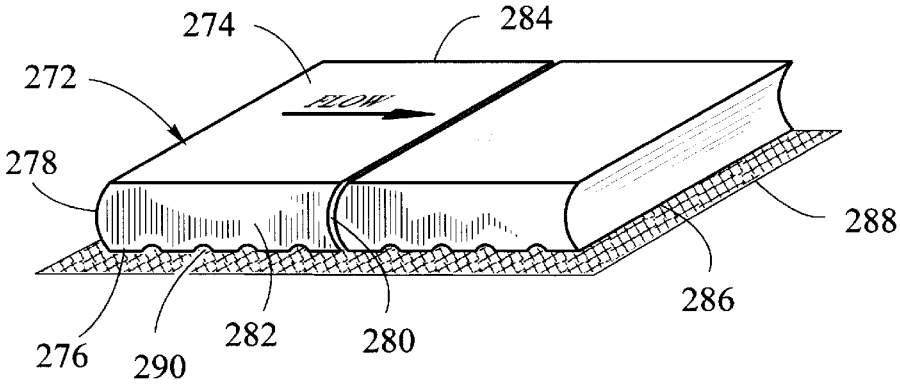
FIG. 31 is a perspective view of a further embodiment of the soil erosion prevention blocks which have arcuate ends.

Referring now to FIG. 31, there is shown still another alternative soil erosion prevention block 272 which is similar to soil erosion block 250 in that it is generally rectangular with an upper planar surface 274 and a lower planar surface 276. End walls 278, 280 are arcuate with end 278 being convex and 280 being concave. Side walls 282, 284 are generally flat and may include through-bores for receiving connectors and one or more channel apertures which extend between planar surfaces 274, 276 for hydraulic relief or for the growth of vegetation. A channel aperture may not be required if a spacer is disposed between the side walls of adjacent blocks so as to provide vertical spaces for the flow of water for hydraulic relief.

Blocks 272 further include a plurality of horizontal hydraulic grooves 290 extending across the lower planar surface 276 between side walls 282, 284. Typically, upon installation, soil erosion prevention blocks 272 rest on a filter fabric 286 providing a permeability to water at the interstices 288 formed between the strands making up the filter fabric 286. The horizontal hydraulic grooves 290 are at least ⅛ inch deep and at least ¾ inch wide to allow adequate water passage beneath blocks 272 to either the vertical spaces between blocks or to one or more vertical channel apertures through the block. As is well known in the art, the weight of the blocks 272 hold the filter fabric 286 on to the bed of the water channel. Because the horizontal hydraulic grooves 290 will tend to become clogged with material carried by the water as the water flows beneath the block 272, and because the filter fabric 286 will tend to deform so as to project into the horizontal hydraulic grooves 290 under normal hydraulic conditions, it is preferred that the horizontal hydraulic grooves 290 have a depth of at least ½ inch. Upon installation, it is not necessary that the horizontal hydraulic grooves 290 of adjacent blocks be in aliginent since the grooves 290 merely allow the water to flow to the vertical channel apertures or the vertical spaces between adjacent blocks.

The horizontal hydraulic grooves 290 will approximately double the amount of area for water passage for hydraulic relief. In the prior art, prior art blocks resting on the filter fabric cover approximately 92% to 94% of the surface area of the filter fabric to water flow, thus only providing a 6 to 8% open area through the filter fabric. Further, the vertical apertures and vertical spaces of prior art blocks typically only provide a 20% open area. The horizontal hydraulic grooves 290 allow additional water flow to the vertical channel apertures and vertical spaces in addition to the typical 6 to 8% open area through the filter fabric. Bottom hydraulic relief is preferred to reduce the number of vertical apertures or channels through the block and to reduce the contact of the block with the filter fabric. All the contact that is required is enough area of the block resting on the fabric to hold the filter fabric down. The horizontal grooves 290 still allow sufficient mass and weight of the block to apply an adequate load onto the filter fabric 286.

By relieving the water pressure utilizing horizontal hydraulic grooves on the bottom of the block instead of relieving that pressure through vertical apertures in the block, the upper planar surface 274 of the block is less rough and yet the same amount of hydrostatic pressure relief is achieved. The use of horizontal hydraulic grooves 290 reduces the number and size of the channel apertures passing through block 290 between planar surfaces 282, 284. By reducing or eliminating vertical apertures through the block 272, the upper planar surface 274 is substantially smooth as compared to prior art blocks thereby substantially reducing the roughness of the top planar surface 274 of the block system. This substantial reduction of roughness allows the cross-sectional flow area of the water through the water channel to be reduced including the reduction of the number of blocks required for the water channel. For example, designing a trapezoidal cross-sectional shaped water channel, a smoother block system will allow that trapezoidal cross-section to be reduced in size and yet allow the same volume of water flow through the water channel as would be permitted by a prior art block system. By reducing the roughness of the upper planar surface of the blocks, the water is able to accelerate more allowing a greater volumetric flow through a given cross-sectional area in the water channel. This substantially improves the hydraulic performance of the blocks.

Figure 32:
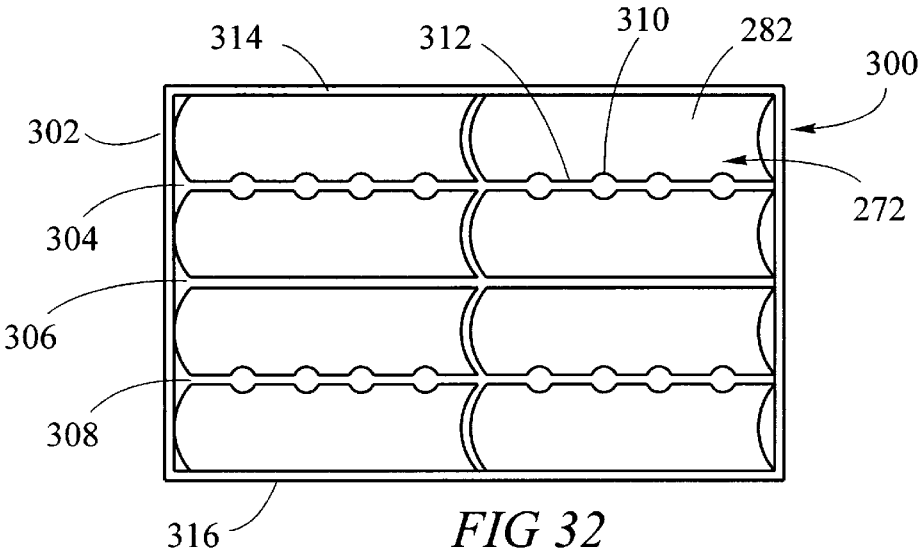
FIG. 32 is a plan view of a production module for production of the soil erosion prevention blocks shown in FIG. 31.

Referring now to FIG. 32, the use of horizontal hydraulic grooves 290 in soil erosion prevention blocks 272 has been made practical through the production of blocks 272 in a vertical position. FIG. 32 shows a plan view of a concrete block module 300. The production module 300 rests on a pallet (not shown). Soil erosion prevention block 272 is produced with side wall 284 adjacent the pallet and side wall 282 adjacent a pressure plate (not shown) which covers the top of module 300 during the production process. The production module 300 includes a rectangular box-like enclosure 302 having three separation plates 304, 306, and 308. Separation plate 306 separates the two adjacent pairs of blocks 272. Separation plates 304, 308 separates the two blocks 272 making up each pair. Separation plates 304,308 include semi-circular molds 310 for forming the horizontal hydraulic grooves 290. The semi-circular molds on separation plates 304, 308 may be molds which are welded to a standard flat plate or an alternative method would be to use a thicker standard metal plate and then mill out the form areas 312 between adjacent semi-circular forms 310. A still further method of producing separation plates 304, 308 would be to cast the plates. A still another method would include placing a plurality of cores through the production module which form the horizontal hydraulic grooves 290 and then split the two blocks 272 making up an adjacent pair.

By producing the blocks 272 in the vertical direction on their sides, it becomes practical to form horizontal hydraulic grooves 290 across the bottom of the blocks 272. In the vertical position, the rectangular blocks 272 can be pushed through the production module 300 so as to cause the block 272 to slide along the semi-circular molds 310. A device may be used to push the block 272 out through the production module 300. The only blocks that can be practically produced on end are blocks which are generally rectangular or square having two flat ends. One end is on the pallet and the other end is against the pressure plate. The four sides can not have any substantial changes in direction, otherwise, they will not slip through the production module. The best prior art production known to the inventor is 2.2 blocks per cycle while the present invention produces up to 8 blocks per cycle.

If a vertical aperture is desired between upper and lower planar surfaces 274, 276 in block 272, a core bar (not shown) may be passed through the sides 314, 316 of production module 300. The core bars are then removed before blocks 272 are removed from production module 300.

Figure 30:
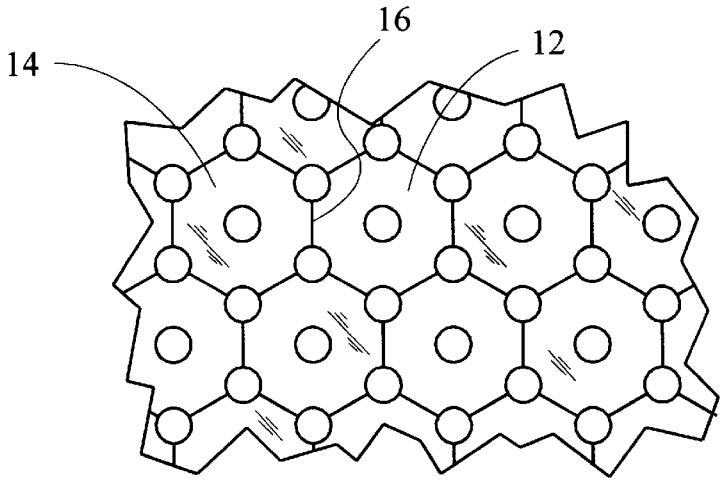
FIG. 30 is a plan view of a plurality of hexagonal shaped soil erosion prevention blocks connected together and installed on an underlying terrain.

Referring now to FIGS. 25 and 30, in operation, a plurality of concrete blocks are positioned with engaging side walls of adjacent blocks abutting against one another to form a continuous array of blocks. A cable, wire, wire rope, synthetic polymer rope, or the like is passed through the connectors of the blocks and other adjacent blocks. It should be appreciated that cables for the embodiments of FIGS. 24–29 may extend in different directions such as at 90° to each other. Next, the free ends of the cable are connected in some suitable manner to form closed loops by which the blocks can be picked up and transported about. Multiple rows of concrete blocks may be laid out side by side and multiple cables past through the connectors. The free ends of the cable may then be connected. Of course, the size and number of blocks within the matrix is dictated by the size and shape of the particular area to be protected from soil erosion, and the size and type of cable used is dictated by the weight and number of blocks used to form the matrix.

The particular area desired to be protected from soil erosion is graded or otherwise smoothed over to form a substantially flat, smooth surface, preferably with no foliage thereon. The matrix of concrete blocks may then be lifted, transported to the site to be protected and positioned thereon. As shown in FIGS. 25 and 28, the adjacent blocks form a block matrix comprising an array of blocks over the particular area to be protected.

Once transported to the site of installation, the block matrix is laid in position and individual blocks repositioned adjacent one another to form a tight matrix of blocks as shown in FIGS. 25 and 28. The cables may then be disconnected from each other and removed. Alternatively, the cable may be embedded or anchored into the ground or supporting surface in order to retain the block matrix in position.

Once the cables have been removed or anchored into the ground, dirt may be poured over the blocks and allowed to settle into the various passageways and recesses formed within and between the blocks, thereby allowing foliage to grow in and between the blocks. After the dirt has been poured over the block matrix, it can be graded to form a surface even with the upper surface of the blocks.

While the preferred embodiment of the invention has been shown and described, modifications thereof can't be made by one skill in the art without departing from the spirit of the invention.

I claim:

1. An erosion control system comprising:

a first erosion control member having a top and a base forming first sides and at least one aperture extending between said top and base forming a first wall;

a second erosion control member having a top and a base forming second sides and at least one aperture extending between said top and base forming a second wall, said first and second erosion control members having a first position with said first and second sides juxtaposed and a second position with said first and second sides juxtaposed; and an expandable connector member having a first projection inserted into said aperture into engagement with said first wall said expandable connector member being expanded as said first and second erosion control members are moved from said first position to said second position to apply a force on said walls toward said first position.

2. The erosion control system of claim 1 wherein said expandable connector member is made of spring metal.

3. The erosion control system of claim 1 wherein said erosion control member is hexagonal in shape forming six sides with arcuate portions in between, said erosion control member having an aperture disposed adjacent each said side.

4. The erosion control system of claim 1 wherein said sides are tapered inwardly and upwardly from said base allowing first and second erosion control members to articulate with respect to each other.

5. The erosion control system of claim 1 further including a plurality of erosion control members made of concrete and connected to one another by expandable connector members to form an interconnected network of erosion control members conforming to the underlying terrain for preventing erosion.

6. The erosion control system of claim 1 wherein said expandable connector member is made of wire.

7. The erosion control system of claim 1 wherein said expandable connector member includes a support for the attachment of a cable.

8. The erosion control system of claim 1 wherein said first and second erosion control members include a hole extending between said top and base and a break groove communicating with said hole.

9. An erosion control system comprising:

a first erosion control member having at least one aperture forming a first side wall;

a second erosion control member having at least one aperture forming a second side wall, said first and second erosion control members having a first position with said first and second sides juxtaposed and a second position with said first and second sides not juxtaposed; and a connector member having a first projection inserted into said aperture of said first erosion control member and a second projection inserted into said aperture of said second erosion control member;

said connector member being expanded to apply force to said side walls as said first and second erosion control members are moved from said first position to said second position;

said connector member including a base from which said first and second projections project and said first and second erosion control members having opposing side walls opposite said first and second side walls, said projections having wing members attachingly engaging said side walls and biasing said projections against said opposing side walls.

10. The erosion control system of claim 9 wherein said base includes a spacer and said base and projections bias said first erosion control member to said second erosion control member.

11. An erosion control system comprising:

an erosion control member having at least one aperture forming a side wall; and a connector member having a first projection for insertion into said aperture and attachingly engaging said side wall and a second projection adapted for attaching said erosion control member to another erosion control member;

said connector member including a base from which said first and second projections project, said projections having wing members which attachingly engage said side wall;

each said wing member having a tapered extension from each said projection, said tapered extension having a terminal end which engages said side wall.

12. The erosion control system of claim 11 wherein said side wall includes a shoulder for engagement with said terminal end.

13. An erosion control system comprising:

an erosion control member having at least one aperture forming a side wall; and a connector member having a first projection for insertion into said aperture and attachingly engaging said side wall and a second projection adapted for attaching said erosion control member to another erosion control member;

said connector member including a base from which said first and second projections project, said projections having wing members which attachingly engage said side wall;

said base including a recess for receiving a cable.

14. An erosion control system comprising:

an erosion control member having at least one aperture forming a side wall; and a connector member having a first projection for insertion into said aperture and attachingly engaging said side wall and a second projection adapted for attaching said erosion control member to another erosion control member;

said connector member including a base from which said first and second projections project, said projections having wing members which attachingly engage said side wall;

said base including a spacer portion which serves as spacer between said erosion control member and another erosion control member.

15. An erosion control system comprising:

an erosion control member having at least one aperture forming a side wall and a connector member having a first projection for insertion into said aperture and attachingly engaging said side wall; and a second projection adapted for attaching said erosion control member to another erosion control member;

each of said projections including a plurality of wing members for frictionally engaging said side wall.

16. The erosion control system of claim 15 wherein said aperture is generally circular in cross-section and said wing members are generally circular in cross-section.

17. The erosion control system of claim 16 wherein said wing members are flexible and deflect upon insertion into said aperture.

18. The erosion control system of claim 15 wherein said connector member is made of plastic.

19. An erosion control system comprising:

an erosion control member having at least one aperture forming a side wall;

a connector member having a first projection for insertion into said aperture and attachingly engaging said side wall; and a second projection adapted for attaching said erosion control member to another erosion control member;

said erosion control member having a hexagonal shape forming six sides with arcuate portions in between said erosion control member having an aperture disposed adjacent each said side; and each of said sides including a chamfered base for receiving a cable.

20. An erosion control system comprising:

first and second erosion control members having top and bottom surfaces, opposing ends, and opposing sides, one said end having a convex arcuate surface extending between said top and bottom surfaces and the other said end having a concave arcuate surface extending between said top and bottom surfaces allowing said first and second erosion control members to articulate at adjacent ends.

21. The erosion control system of claim 20 wherein said concave arcuate surface of said first erosion control member forms a pair of lips for restricting the vertical movement of said convex arcuate surface on second erosion control member.

22. The erosion control system of claim 20 wherein each said bottom surface is adjacent the ground surface and has at least one groove extending along said bottom surface for the passage of water between the ground surface and said erosion control member.

23. The erosion control block of claim 22 wherein said erosion control member includes at least one vertical aperture in communication with said at least one groove.

24. The erosion control system of claim 20 further including a spacer disposed between said first and second erosion control members forming a space therebetween and at least one aperture extending between said opposing sides and through said erosion control members for receiving a cable.

25. The erosion control system of claim 24 wherein said spacer includes a hole therethrough for the passage of said cable.

26. The erosion control system of claim 25 further including a second holy through said spacer receiving another cable extending between said first and second erosion control members.

27. An erosion control system for positioning upon the ground for controlling, erosion comprising:

a first erosion control member having first and second surfaces forming first and second sides and at least one first aperture passing through said first erosion control member from said first side to said second side, said second surface being adjacent the ground;

a second erosion control member having third and fourth surfaces forming third and fourth sides and at least one second aperture passing through said second erosion control member from said third side to said fourth side, said fourth surface being adjacent the ground;

said first and second erosion control members having a first position with said first and third sides juxtaposed and a second position with said first and third sides not juxtaposed; and a connector member having a first projection, a base, and a second projection, said first projection extending from said base in a first direction and said second projection extending from said base in an opposite direction, said first projection being inserted into said fir aperture and attachingly engaging said first erosion control member and said second projection being inserted into said second aperture and attaching said first erosion control member to said second erosion control member, said base flexing as said erosion control members move from said second position to said first position.

28. The erosion control system of claim 22 wherein said first and third sides have a recess in which said aperture passes and in which said base of said connector member is housed.

29. The erosion control system of claim 28 wherein first said erosion control member includes at least one groove extending along said second surface of said first erosion control member for the passage of water between said first erosion control member and the ground and a hole extending between said first and second surfaces in communication with said at least one groove.

30. The erosion control system of claim 27 wherein said base of said connector member forms a spacer portion for spacing said first erosion control member from said second erosion control member.

31. The erosion control system of claim 22 wherein said base include first members attached to said first and second projections and a second member extending between said first members.

32. The erosion control system of claim 31 wherein said second member is not co-axial with said first and second projections.

33. The erosion control system of claim 31 wherein said first members are connected to support a cable.

34. The erosion control system of claim 31 wherein said first members extend over said first and second apertures.

35. The erosion control system of claim 27 wherein said first and second projections include extending accordion members which engage said first and second erosion control members at said first and second apertures.

36. The erosion control system of claim 35 wherein said accordion members are disc-like members extending outwardly from said first and second projections.

37. An erosion control system for positioning upon the ground for controlling erosion comprising:

an erosion control member having first and second surfaces forming a plurality of sides and at least one aperture passing through said erosion control member from one side to an opposite side, said second surface being adjacent the ground; and a connector member having a first projection extending in a first direction and a second projection extending in an opposite direction, said first projection being inserted into said aperture and attachingly engaging said erosion control member; and said second projection adapted for attaching said erosion control member to another erosion control member; and a cable passing through said aperture and through a hole in said connector member for supporting said erosion control member.

38. The erosion control system of claim 37 wherein said sides are tapered allowing adjacent erosion control members to articulate with respect to each other.

39. An erosion control system comprising:

an erosion control member having at least one aperture forming a side wall and a connector member having a first projection for insertion into said aperture and attachingly engaging said side wall; and a second projection adapted for attaching said erosion control member to another erosion control member;

a plurality of erosion control members connected to one another by connector members to form an interconnected network of erosion control members conforming to the underlying terrain for preventing erosion:

said connector member including a base from which a third projection projects whereby said first; second, and third projections attach said erosion control member, said another erosion control member, and a third erosion control member.

40. A method of producing an erosion control block comprising:

pouring concrete into a production module for forming the block on one of its sides with the top and bottom planar surfaces of the block in the vertical position;

forming a plurality of grooves across the bottom planar surface of the block; and removing the block by pushing the block out of the production module along the grooves.

41. The method of claim 40 further including forming a plurality of blocks in the production mold as concrete is poured into the production mold and extending core bars between adjacent blocks to form apertures along one side of the erosion control blocks.

42. An erosion control system comprising:

a first erosion control member having first and second surfaces forming first sides and at least one aperture extending between said first and second surfaces forming a first wall;

a second erosion control member having first and second surfaces forming second sides and at least one aperture extending between said first and second surfaces forming a second wall, said first and second erosion control members having a first position with said first and second sides juxtaposed and a second position with said first and second sides not juxtaposed;

a connector member having a first projection for insertion into said aperture of said first erosion control member and attachingly engaging said side wall and a second projection for insertion into said aperture of said second erosion control member and attachingly engaging said side wall; and said projections prior to insertion into said apertures being separated by a distance less than the distance between the apertures of said first erosion control member and said second erosion control member such that the insertion of said projections into said apertures expands said distance to create a constant clamping force to bias said first erosion control member to said second erosion control member.

43. An erosion control system comprising:

a first erosion control member having at least one aperture forming a first side walls;

a second erosion control member having at least one aperture forming a second side wall, said first and second erosion control members having a first position with said first and second sides juxtaposed and a second position with said first and second sides not juxtaposed; and a connector member having a first projection inserted into said aperture of said first erosion control member and a second projection inserted into said aperture of said second erosion control member;

said connector member being expanded to apply force to said side walls as said first and second erosion control members are moved from said first position to said second position; and said connector member further including a base and wing members extending at an angle from said projections toward said base.

44. An erosion control system comprising:

a first erosion control member having at least one aperture forming a first side wall;

a second erosion control member having at least one aperture forming a second side wall, said first and second erosion control members having a first position with said first and second sides juxtaposed and a second position with said first and second sides not juxtaposed; and a connector member having a first projection inserted into said aperture of said first erosion control member and a second projection inserted into said aperture of said second erosion control member;

said connector member being expanded to apply force to said side walls as said first and second erosion control members are moved from said first position to said second position; and said connector member including a base having an expansion portion.

45. An erosion control system for positioning upon the ground for controlling erosion comprising:

an erosion control member having first and second surfaces forming a plurality of sides and at least one aperture passing through said erosion control member from one side to an opposite side, said second surface being adjacent the ground; and a connector member having a first projection extending in a first direction and a second projection extending in an opposite direction, said first projection being inserted into said aperture and attachingly engaging said erosion control member; and said second projection adapted for attaching said erosion control member to another erosion control member;

said connector member includes a spacer portion for spacing said erosion control member from said another erosion control member; and said spacer member including an aperture for receiving a cable.

46. An erosion control system comprising:

a first erosion control member having at least one aperture forming a first side wall;

a second erosion control member having at least one aperture forming a second side wall, said first and second erosion control members having a first position with said first and second sides juxtaposed and a second position with said first and second sides not juxtaposed; and a connector member having a first projection inserted into said aperture of said first erosion control member and a second projection inserted into said aperture of said second erosion control member;

said connector member being expanded to apply force to said side walls as said first and second erosion control members are moved from said first position to said second position; and said connector member including a third projection inserted into an aperture of a third erosion control member.

47. An erosion control system comprising:

a first erosion control member having at least one aperture forming a first side wall;

a second erosion control member having at least one aperture forming a second side wall, said first and second erosion control members having a first position with said first and second sides juxtaposed and a second position with said first and second sides not juxtaposed; and a connector member having a first projection inserted into said aperture of said first erosion control member and a second projection inserted into said aperture of said second erosion control member;

said connector member being expanded to apply force to said side walls as said first and second erosion control members are moved from said first position to said second position; and said connector member including a plurality of winged members projecting from said first and second projections.

48. An erosion control system comprising:

first and second erosion control members having top and bottom surfaces, opposing ends, and opposing sides, one said end having a convex arcuate surface extending between said top and bottom surfaces and the other said end having a concave arcuate surface extending between said top and bottom surfaces allowing said first and second erosion control members to articulate at adjacent ends;

at least one aperture extending between the said opposing sides and through said erosion control members for receiving a cable;

a spacer between said first and second erosion control members at said aperture;

said spacer includes a hole therethrough for the passage of said cable; and said spacer including a second hole for receiving a hoisting cable.

* * * * *